US007517199B2

(12) United States Patent
Reed et al.

(10) Patent No.: US 7,517,199 B2
(45) Date of Patent: Apr. 14, 2009

(54) CONTROL SYSTEM FOR AN AIR OPERATED DIAPHRAGM PUMP

(75) Inventors: David Alan Reed, Greenfield, IN (US); Timothy David Hogue, Indianapolis, IN (US)

(73) Assignee: Proportion Air Incorporated, McCordsville, IN (US)

( * ) Notice: Subject to any disclaimer, the term of this patent is extended or adjusted under 35 U.S.C. 154(b) by 379 days.

(21) Appl. No.: 10/991,296

(22) Filed: Nov. 17, 2004

(65) Prior Publication Data

US 2006/0104829 A1 May 18, 2006

(51) Int. Cl.
*F04B 49/22* (2006.01)
*F04B 43/06* (2006.01)

(52) U.S. Cl. ..... 417/46; 417/395

(58) Field of Classification Search ..... 417/46, 417/393, 394, 395

See application file for complete search history.

(56) References Cited

U.S. PATENT DOCUMENTS

| | | | | | |
|---|---|---|---|---|---|
| 3,741,689 | A | * | 6/1973 | Rupp | 417/393 |
| 3,782,863 | A | | 1/1974 | Rupp | |
| 3,838,946 | A | | 10/1974 | Schall | |
| 4,111,226 | A | | 9/1978 | Cameron | |
| 4,238,992 | A | | 12/1980 | Tuck, Jr. | |
| 4,242,941 | A | | 1/1981 | Wilden et al. | |
| 4,247,264 | A | | 1/1981 | Wilden | |
| 4,270,441 | A | | 6/1981 | Tuck, Jr. | |
| 4,339,985 | A | | 7/1982 | Wilden | |
| 4,406,596 | A | | 9/1983 | Budde | |
| 4,422,835 | A | | 12/1983 | McKee | |
| 4,465,102 | A | | 8/1984 | Rupp | |
| 4,472,115 | A | | 9/1984 | Rupp | |
| D275,858 | S | | 10/1984 | Wilden | |
| 4,478,560 | A | | 10/1984 | Rupp | |
| 4,549,467 | A | | 10/1985 | Wilden et al. | |
| D294,946 | S | | 3/1988 | Wilden | |
| D294,947 | S | | 3/1988 | Wilden | |
| 4,856,969 | A | | 8/1989 | Forsythe et al. | |
| 4,901,758 | A | | 2/1990 | Cook et al. | |
| 5,062,770 | A | * | 11/1991 | Story et al. | 417/46 |
| 5,165,869 | A | | 11/1992 | Reynolds | |
| D331,412 | S | | 12/1992 | Wilden | |
| 5,174,731 | A | | 12/1992 | Korver | |
| 5,257,914 | A | | 11/1993 | Reynolds | |
| 5,332,372 | A | | 7/1994 | Reynolds | |
| 5,362,212 | A | | 11/1994 | Bowen et al. | |
| 5,370,507 | A | | 12/1994 | Dunn et al. | |
| 5,375,309 | A | | 12/1994 | Dunn | |
| 5,375,625 | A | | 12/1994 | Reynolds | |
| 5,378,122 | A | | 1/1995 | Duncan | |
| 5,441,281 | A | | 8/1995 | Baland | |
| 5,538,042 | A | | 7/1996 | Baland | |

(Continued)

OTHER PUBLICATIONS

Accessories Brochure <http://www.warrenrupp.com/pdf/ACCESSORIES%20BROCHURE.pdf?CategoryID=12> entitled "Discover the Sandpiper Solutions: Accesories & Controls" by Warren Rupp, Inc., 2004.

(Continued)

*Primary Examiner*—Charles G Freay
(74) *Attorney, Agent, or Firm*—Baker & Daniels LLP

(57) ABSTRACT

The present invention includes methods and apparatuses for operating and controlling AOD pumps.

11 Claims, 37 Drawing Sheets

U.S. PATENT DOCUMENTS

| | | | | |
|---|---|---|---|---|
| 5,607,290 | A | 3/1997 | Duncan | |
| 5,611,678 | A | 3/1997 | Pascual | |
| 5,619,786 | A | 4/1997 | Baland | |
| 5,628,229 | A | 5/1997 | Krone et al. | |
| 5,651,389 | A * | 7/1997 | Anderson | 137/565.11 |
| 5,724,881 | A | 3/1998 | Reynolds | |
| 5,743,170 | A | 4/1998 | Pascual et al. | |
| D400,210 | S | 10/1998 | Reynolds et al. | |
| 5,816,778 | A | 10/1998 | Elsey, Jr. et al. | |
| 5,819,792 | A | 10/1998 | Reynolds | |
| 5,851,109 | A | 12/1998 | Reynolds | |
| 5,927,954 | A | 7/1999 | Kennedy et al. | |
| 5,950,523 | A | 9/1999 | Reynolds | |
| 5,957,670 | A | 9/1999 | Duncan et al. | |
| 5,971,402 | A | 10/1999 | Northrop et al. | |
| 5,979,477 | A | 11/1999 | Stillings | |
| 5,996,422 | A | 12/1999 | Buck et al. | |
| 5,996,627 | A | 12/1999 | Reynolds | |
| 6,004,105 | A | 12/1999 | Reynolds | |
| 6,036,445 | A | 3/2000 | Reynolds | |
| D426,553 | S | 6/2000 | Jack et al. | |
| 6,071,090 | A * | 6/2000 | Miki et al. | 417/395 |
| 6,102,363 | A | 8/2000 | Eberwein | |
| 6,106,246 | A | 8/2000 | Steck et al. | |
| 6,126,403 | A * | 10/2000 | Yamada | 417/46 |
| 6,129,525 | A | 10/2000 | Reynolds | |
| 6,142,749 | A | 11/2000 | Jack et al. | |
| 6,152,705 | A | 11/2000 | Kennedy et al. | |
| 6,158,982 | A | 12/2000 | Kennedy et al. | |
| D435,855 | S | 1/2001 | Donelson et al. | |
| 6,168,387 | B1 | 1/2001 | Abel et al. | |
| 6,168,394 | B1 | 1/2001 | Forman et al. | |
| 6,241,487 | B1 | 6/2001 | Reynolds | |
| 6,257,845 | B1 | 7/2001 | Jack et al. | |
| 6,280,149 | B1 | 8/2001 | Abel et al. | |
| 6,357,723 | B2 | 3/2002 | Kennedy et al. | |
| 6,435,845 | B1 | 8/2002 | Kennedy et al. | |
| 6,554,578 | B1 | 4/2003 | Siegel | |
| 6,561,774 | B2 | 5/2003 | Layman | |
| RE38,239 | E | 8/2003 | Duncan | |
| 6,604,909 | B2 | 8/2003 | Schoenmeyr | |
| 6,619,932 | B2 | 9/2003 | Murata | |
| 6,623,245 | B2 | 9/2003 | Meza et al. | |
| 6,644,930 | B1 | 11/2003 | Kuismanen | |
| 6,685,443 | B2 | 2/2004 | Simmons et al. | |
| 6,695,593 | B1 | 2/2004 | Steck et al. | |
| 6,749,331 | B1 | 6/2004 | Hughes | |
| 6,767,189 | B2 | 7/2004 | Kleibrink | |
| 6,829,542 | B1 | 12/2004 | Reynolds et al. | |
| 6,962,175 | B2 | 11/2005 | Viken | |
| 6,988,508 | B2 | 1/2006 | Bauer et al. | |
| 7,021,909 | B1 | 4/2006 | Steck | |
| 7,134,849 | B1 | 11/2006 | Steck et al. | |

OTHER PUBLICATIONS

Service and Operating Manual <http://www.warrenrupp.com/svc-man/RuppTech-POKits%20for%20SPII%20%26%20MII%20svc20%man.pdf?CategoryID=12> entitled "RuppTech® Pulse Output Kits for Sandpiper II® and Marathon II® Pumps" by Warren Rupp, Inc., 2002.

Service and Operating Manual <http://www.warrenrupp.com/svc-man/s20%20SMetallic%20svc%20man.pdf> entitled "Sandpiper® Model S20 Metallic Design Level 1" by Warren Rupp, Inc., 2004.

Service and Operating Manual <http://www.warrenrupp.com/svc-man/s30%20SMetallic%20svc%20man.pdf> entitled "Sandpiper® Model S30 Metallic Design Level 1" by Warren Rupp, Inc., 2004.

Webpage <http://www.diaphragmpumps.co.uk/Batch.php> entitled "Batch Controllers and Stroke Counters" by Diaphragm Pumps, Ltd., 2004.

Webpage <http://www.wildenpump.com/techinfo/p-flov.cfm> entitled "Pro-Flo V Technology" by Wilden Pump & Engineering Company, date unknown.

David Hollen, Engineering Handbook for Air-Powered Double Diaphragm Pumps, date unknown, Yamada America, Inc., West Chicago, Illinois.

Ingersoll-Rand, Pumps and Products of Industrial Assembly, Catalog, 2001, Bryan, Ohio, http://www.irtools.com/ARO/lit/downloads/INDASSM.pdf.

Ingersoll-Rand, Pumps and Accessories for the Process Industries, Catalog, 2000, Bryan, Ohio, http://www.irtools.com/ARO/lit/downloads/9910-P.pdf.

Trebor, Model 110E Pump, Operation/Maintenance Manual, Jan. 2002, West Jordan, Utah, http://www.treborintl.com/custserv/manuals/Pumps%20&%20Surges/110/M110E-ac.pdf.

Trebor, PC5 Oscillator, Operation/Maintenance Manual, Mar. 2000, West Jordan, Utah, http://www.treborintl.com/custserv/manuals/Other/PC5/MPC5-ba.pdf.

Trebor, PC6 Oscillator, Operation/Maintenance Manual, Mar. 2000, West Jordan, Utah, http://www.treborintl.com/custserv/manuals/Other/PC6/MPC6-aa.pdf.

Trebor, PC10 Oscillator, Operation/Maintenance Manual, Jan. 2000, West Jordan, Utah, http://www.treborintl.com/custserv/manuals/Other/PC10/MPC10-aa.pdf.

Trebor, PC201 Pump Controller, Operation/Maintenance Manual, Aug. 2000, West Jordan, Utah, http://www.treborintl.com/custserv/manuals/Other/PC20/MPC20i-aa.pdf.

Trebor, Maxim External Control Pump Interface to a PLC Manual, Apr. 1999, West Jordan, Utah, http://www.treborintl.com/custserv/manuals/Other/PLC_Interface.pdf.

Trebor, Maxim External Control Pump Interfact to IWAKI AC1 Controller Manual, Apr. 1999, West Jordan, Utah, http://www.treborintl.com/custserv/manuals/Other/Iwaki_AC1_CI.pdf.

Trebor, Maxim External Control Pump Interfact to IWAKI AC3 Controller Manual, Apr. 1999, West Jordan, Utah, http://www.treborintl.com/custserv/manuals/Other/Iwaki_AC3_CI.pdf.

Trebor, M20 Pump Monitor, Operation/Maintenance Manual, Feb. 2001, West Jordan, Utah, http://www.treborintl.com/custserv/manuals/Other/M20/M20-ca.pdf.

Warren Rupp, Sandpiper Sandpiper II, Principles of Operation, 2002, Mansfield, Ohio, http://www.warrenrupp.com/prin-of-op.html.

Warren Rupp, Sandpiper Sandpiper II, Principles of Operation, Rupp Guard Spill Prevention 2002, Mansfield, Ohio http://www.warrenrupp.com/install-guide.html.

Warren Rupp, Guaranteed Non-Stalling Air Valve Performance, Oct. 2000, Mansfield, Ohio, http://www.warrenrupp.com/pdf/no-stall-guarantee-flyer.pdf.

Wilden Pump & Engineering Co., Principles of Operation, date unknown http://www.wildenpump.com/techinfo/operation.cfm.

Wilden Pump & Engineering Co., How to Read a Wilden Flow Curve, date unknown http://www.wildenpump.com/techinfo/read.cfm.

Wilden Pump & Engineering Co., Pump User's Guide, Jun. 2002, Grand Terrace, California http://www.wildenpump.com/pugs/ENGLISH_PUG.pdf.

Yamada America, Inc., Air Valve Technology, 2006 http://www.yamadapump.com/air_valve/air_valve.html.

Yamada America, Inc., Yamada Pumps-Engineered for Performance. Designed for Life, 2006 http://www.yamadapump.com/advantage/advantage_yamada.html.

Yamada America, Inc., Ten Intelligent Reasons to Specify a Yamada Air-Powered Double Diaphragm Pump, 2006 http://www.yamadapump.com/advantage/ten_reasons.html.

Yamada America, Inc., Pump Controller Specifications, 2006 http://www.yamadapump.com/specialty/spec_controller.html.

Proportion-Air, Diagram of QBI Servor Controlling PSR in Response to Signal from DSTY.

Service and Operating Manual <http://www.warrenrupp.com/svc-man/s30%20SMetallic%20svc%20man.pdf> entitled Sandpiper® Model S30 Metallic Design Level 1 by Warren Rupp, Inc., 2004.

"Champion SL20 Slurry/Booster Pump" Operation/Maintenance Manual, IDEX Corporation, Nov. 2006, 25 pages.

* cited by examiner

302

| 174 | 170 | 166 | 162 | 210 |
|---|---|---|---|---|
| ON | OFF | ON | OFF | OFF |
| | | | | |
| OFF | OFF | OFF | OFF | ON |
| | | | | |
| OFF | ON | OFF | OFF | OFF |
| | | | | |
| OFF | ON | OFF | ON | OFF |
| | | | | |
| OFF | OFF | OFF | OFF | ON |
| | | | | |
| OFF | OFF | ON | OFF | OFF |

342

| 174 | 170 | 166 | 162 | 210 |
|---|---|---|---|---|
| ON | OFF | ON | OFF | OFF |
| | | | | |
| OFF | OFF | ON | OFF | OFF |
| | | | | |
| OFF | ON | OFF | ON | OFF |
| | | | | |
| OFF | ON | OFF | OFF | OFF |
| | | | | |

| 174 | 170 | 166 | 162 | 210 |
|---|---|---|---|---|
| ON | OFF | ON | OFF | OFF |
| | | | | |
| OFF | OFF | ON | OFF | OFF |
| | | | | |
| OFF | OFF | OFF | OFF | ON |
| | | | | |
| OFF | ON | OFF | ON | OFF |
| | | | | |
| OFF | ON | OFF | OFF | OFF |
| | | | | |
| OFF | OFF | OFF | OFF | ON |

CONTROL SYSTEM FOR AN AIR OPERATED DIAPHRAGM PUMP

BACKGROUND OF THE INVENTION

The present invention relates generally to a high efficiency control system for an air operated diaphragm (AOD) pump and methods for controlling AOD pumps.

BACKGROUND AND SUMMARY

AOD pumps are used in the sanitation, industrial, and medical fields to pump liquids or slurries. Flexible diaphragms in AOD pumps generally exhibit excellent wear characteristics even when used to pump relatively harsh components such as concrete. Diaphragms pumps use the energy stored in compressed gases to move liquids. AOD pumps are particularly useful for pumping higher viscosity liquids or heterogeneous mixtures or slurries such as concrete. Compressed air is generally used to power AOD pumps in industrial settings. Most AOD pumps are not as efficient as electric pumps having similar pumping capabilities.

Additional features and advantages of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

The drawings discussed below have been drawn substantially according to the ANSI Y32.1 convention. Therefore, the porting configurations of the depicted valves are shown in a default position throughout the several stages of operation for each embodiment described, as is customary in the art. The active porting configurations for each drawing are, however, shown in bold to assist the reader in understanding the description.

Figure 1:
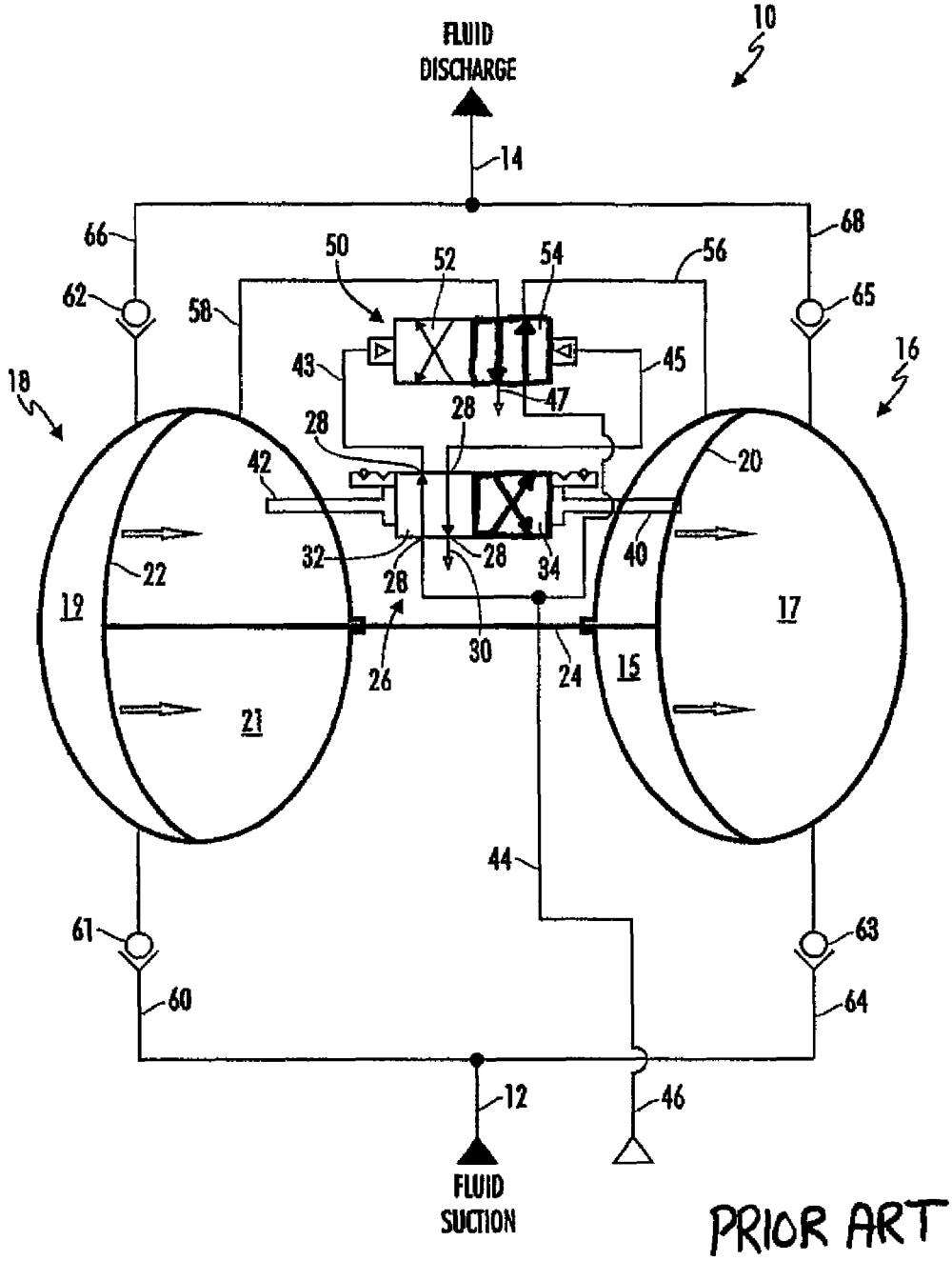
FIG. 1 is a schematic illustrating one embodiment of a AOD pump.
Figure 2:
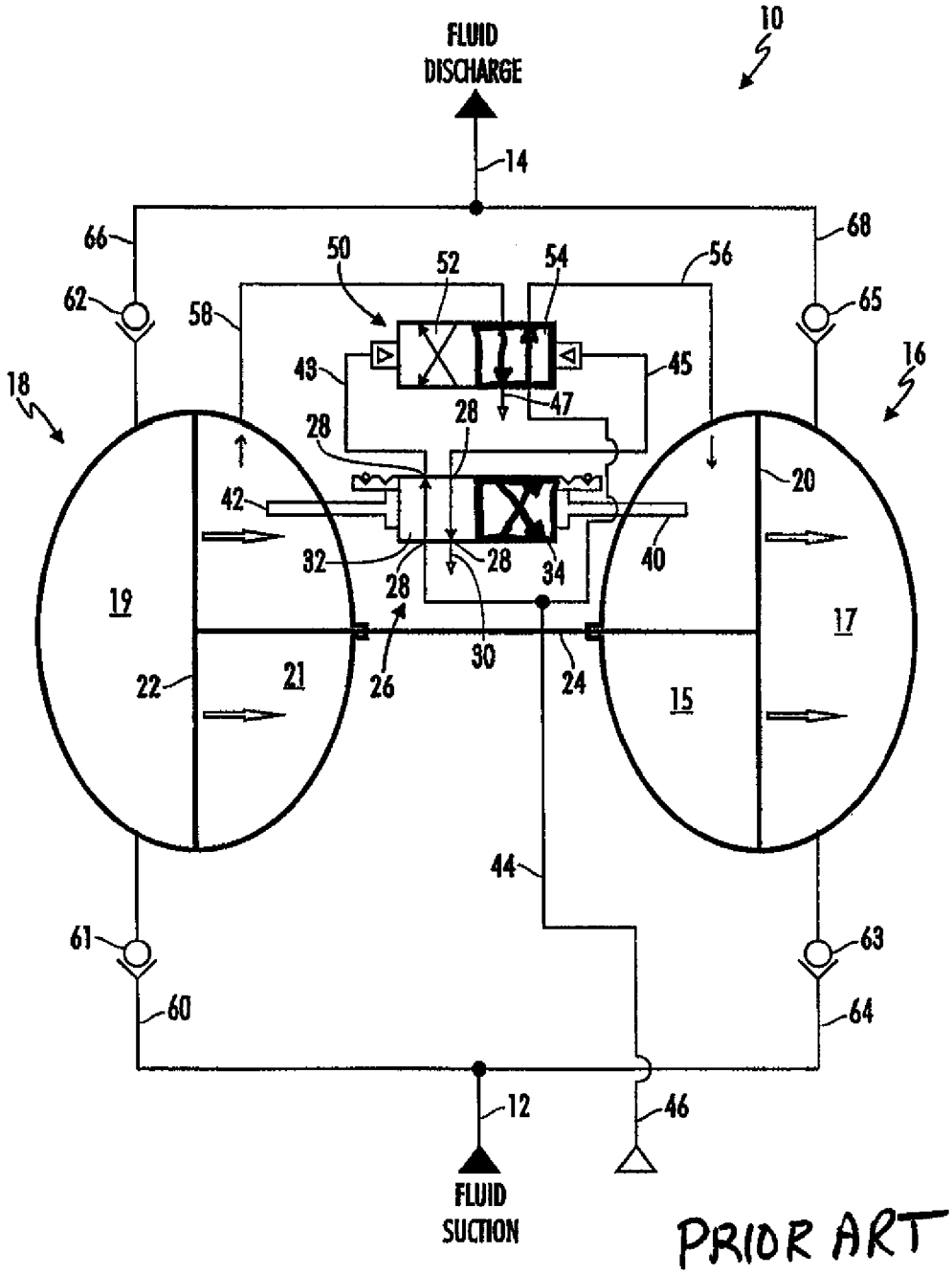
FIG. 2 is a schematic illustrating the AOD pump shown in FIG. 1.
Figure 3:
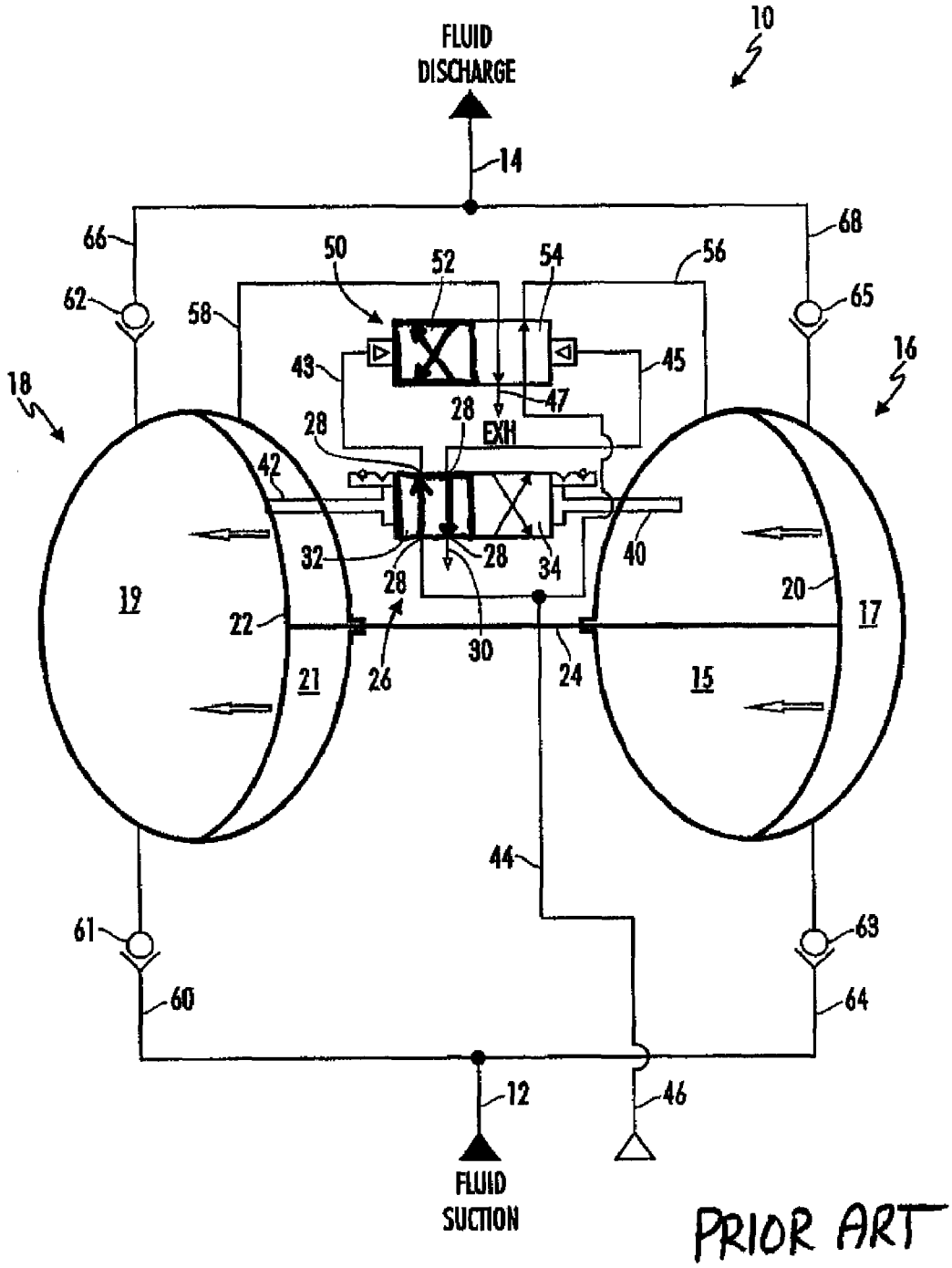
PRIOR ART FIG. 3
FIG. 3 is a schematic illustrating the AOD pump shown in FIG. 1.

A prior art pump schematic for a AOD pump is shown in FIGS. 1 through 3. AOD pump 10 includes a pair typically, but could be one or more diaphragm chambers 16 and 18, a pilot valve 26, a directional valve 50, and piping configured to allow the pump to operate. In operation, AOD pump 10 develops fluid suction in line 12 to receive fluid and discharges fluid from line 14. In FIG. 1, diaphragms 20 and 22 are in the end-of-stroke left configuration, which is defined as the left-most position of the diaphragms, and are beginning to move towards the right side of diaphragm chambers 16 and 18 to an end-of-stroke right position, shown in FIG. 3. In FIG. 2, diaphragm 20 and 22 are moving rightward towards the end-of-stroke right position.

Diaphragm 22 of diaphragm chamber 18 and diaphragm 20 of diaphragm chamber 16 are connected by rod 24, which rigidly connects the diaphragms together. In the end-of-stroke left condition, as shown in FIG. 1, diaphragm 20 has just contacted control rod 40 which moves porting configuration 34 into the active position of pilot valve 26. Porting configuration 34 is locked in this end-of-stroke left condition until diaphragm 22 contacts control rod 42 and moves and locks porting configuration 32 in the active position of pilot valve 26 (the end-of-stroke right condition) as shown in FIG. 3.

In the end-of-stroke left configuration, as shown in FIG. 1, pilot valve 26, which is a two-position position, four port valve has porting configuration 34 in the active position. In FIG. 1, diaphragm 20 contacts control rod 40 which actuates pilot valve 26 to change porting configurations. Pilot valve 26 includes four ports 28, which are connected to lines 43, 44, 45 and exhaust port 30. In this configuration, air supplied from line 44 is supplied to line 45 and air in line 43 is exhausted to exhaust port 30. The air supplied to line 45 is used to position porting configuration 54 of directional valve 50 in the active position. Directional valve 50 is a four-port, two-position valve. In this configuration, air from line 58 from right side 21 of diaphragm chamber 18 is exhausted to the atmosphere through exhaust port 47. Air from air supply line 44 is supplied to line 56, which inputs air into left side 15 of diaphragm chamber 16. The air input into left side 15 of diaphragm chamber 16 increases in pressure until diaphragm 20 begins moving rightward as shown in FIG. 2. Simultaneously, diaphragm 22 is pulled to the right side 21 of diaphragm chamber 18 by rod 24 and air is forced out of right side 21 of diaphragm chamber 18 through line 58 and exhausted to the atmosphere through port 47 of directional valve 50.

As diaphragms 20 and 22 begin moving toward the right side of diaphragm chambers 16 and 18 from the end-of-stroke left positions, fluid suction or a vacuum is applied to line 12 through line 60 and left side 19 of diaphragm chamber 18 begins filling with fluid. Line 66 has a check valve or one way valve 62 that prevents fluid in line 66 from being pulled back into left side 19 of diaphragm chamber 18 as diaphragm 22 moves rightward. At the same time, diaphragm 20 is moving toward the right side of diaphragm chamber 16 and forcing fluid out of right side 17 of diaphragm chamber 16 through line 68 to fluid discharge line 14. Check valve 63 in line 64 prevents fluid from flowing back into line 12 when diaphragm 20 moves rightward.

Referring now to FIG. 3, the air supplied by line 56 has forced diaphragm 20 to the rightmost position, which simultaneously positions diaphragm 22 in the right most position due to rod 24 connecting the diaphragms 20 and 22. The diaphragms are now in the end-of-stroke right position. In the end-of-stroke right position diaphragm 22 contacts control rod 42 which actuates pilot valve 26 to change from porting configuration 34 to porting configuration 32. Porting configuration 32 connects air supply line 44 with line 43 and exhausts line 45 through line 30 in the pilot valve, which actuates directional valve 50 to change from porting configuration 54 to porting configuration 52. With valve 50 in this configuration, air from air supply 46 is carried through line 44 to line 58 and used to pressurize right side 21 of diaphragm chamber 18. At the same time, when directional valve 50 has porting configuration 52 in the active position, air from left side chamber 15 of diaphragm chamber 16 is exhausted through line 56 to exhaust port 47 through directional valve 50.

As diaphragms 20 and 22 begin moving leftward from the end-of-stroke right positions in diaphragm chamber 16 and 18, fluid suction is applied to line 12 through line 64 and right side 17 of diaphragm chamber 16 begins filling with fluid. Line 68 has a check valve 65 that prevents fluid in line 68 from being pulled back into right side 17 of diaphragm chamber 16 as diaphragm 20 moves leftward. At the same time, diaphragm 22 is moving toward the left side of diaphragm chamber 18 and forcing fluid out of left side 19 of diaphragm chamber 18 through line 66 to fluid discharge line 14. Check valve 61 in line 60 prevents fluid from flowing back into line 60 when diaphragm 22 moves leftward.

Air is supplied to right side 21 of diaphragm chamber 18 until diaphragm 20 in diaphragm chamber 16 contacts control rod 40 of pilot valve 26. When diaphragm 20 contacts control rod 40 indicating end-of-stroke left, the porting configuration of pilot valve 26 is changed from porting configuration 32 to porting configuration 34 as shown in FIG. 1. When pilot valve 26 has porting configuration 34 in the active position, directional valve 50 is changed from porting condition 52 to porting configuration 54 as shown in FIG. 1. Pump 10 operates continuously with only pressurized air supplied as described above. In alternative embodiments, AOD pump 10 may include alternative valve configurations. Pilot valve 26 could be replaced by position sensors in alternative embodiments.

Figure 4:
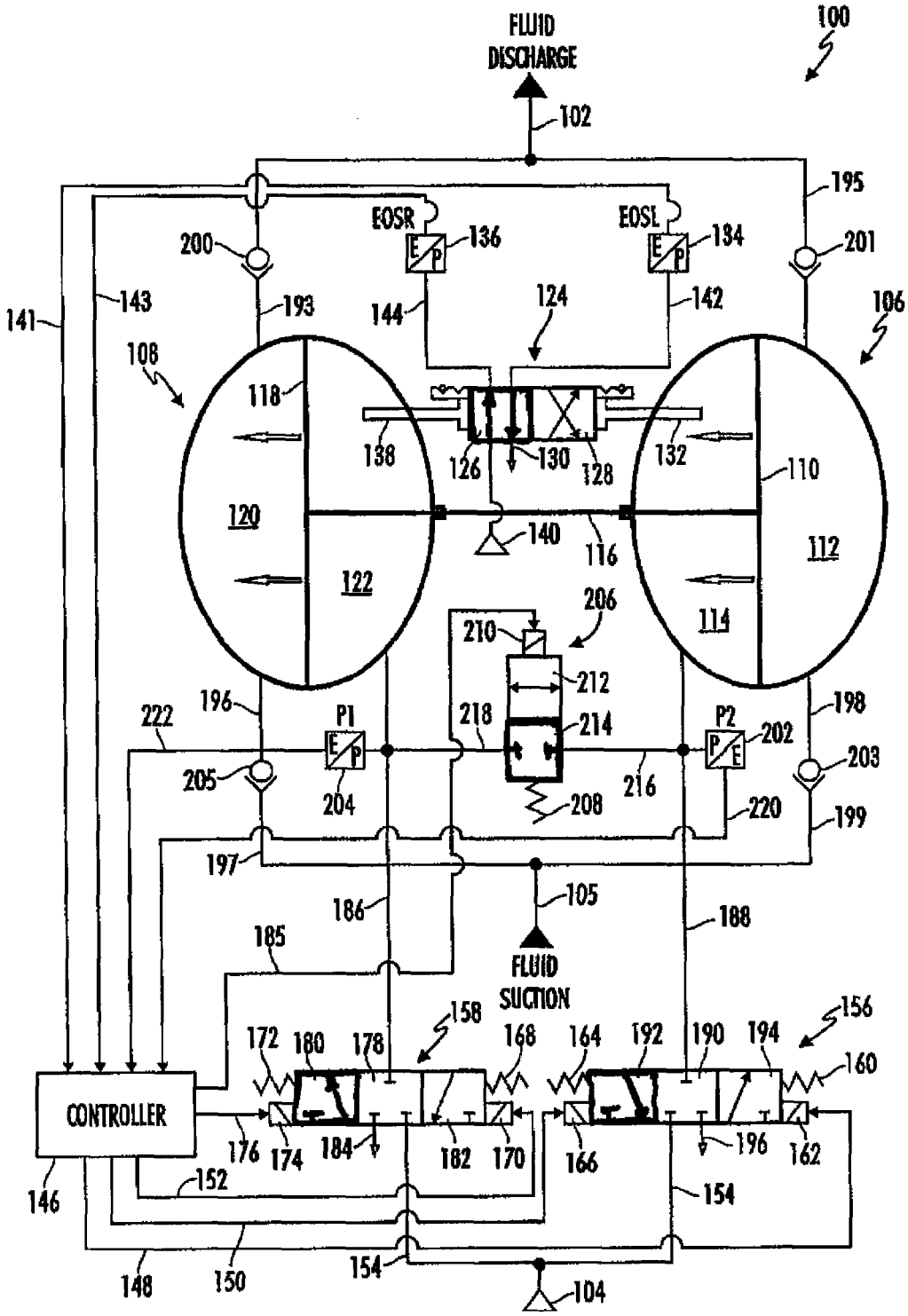
FIG. 4 is a schematic illustrating another embodiment of a AOD pump.

One embodiment of a method and apparatus of the present invention is shown in FIGS. 4-8. AOD pump 100 includes diaphragm chambers 106 and 108, pilot valve 124, controller 146 and valves 158, 156, and 206. AOD pump 100 produces suction at line 105 to receive fluid and outputs fluid at line 102. AOD pump 100 operates in a similar fashion to AOD pump 10 shown in FIGS. 1 and 2 with several exceptions. Directional valve 50 of AOD pump 10 has been replaced with valves 156, 158, and 206. Pilot valve 124 performs a function similar to pilot valve 26 of AOD pump 10. Instead of driving a directional valve, pilot valve 124 keys sensors 134 and 136 which output a signal indicative of the end-of-stroke left or end-of-stroke right conditions similar to pilot valve 26 in AOD pump 10. In FIG. 4, diaphragms 110 and 118 have recently been in the end-of-stroke right position and are moving leftward. Pilot valve 124 is still in the end-of-stroke right position and porting configuration 126 is in the active position. In the end-of-stroke right position, diaphragm 118 has contacted control rod 138 to actuate pilot valve 124 to move porting configuration 126 to the active position. Porting configuration 126 allows compressed air from air supply 140 to pass to line 144 to sensor 136. Sensor 136 outputs an electrical signal through line 143 to controller 146 indicating that pump 100 is in the end-of-stroke right configuration. Also in porting configuration 126, air in line 142 is vented to the atmosphere via exhaust port 130. Controller 146 receives end-of-stroke left and end-of-stroke right signals from sensors 134 and 136 during operation of pump 100.

Controller 146 also receives input from sensors 204 and 202 which indicate the air pressure in the pressurized right side 122 and pressurized left side 114 of diaphragm chambers 108 and 106. Controller 146 outputs signals through lines 148, 150, 152, 176, and 185 to control valves 156, 158, and 206. Valves 156 and 158 are conventional three port, three position, spring-centered valves with solenoid operators to achieve left and right positions for each valve. In alternative embodiments, five port, three position valves could also be used. The three ports of valve 156 include exhaust port 196, line 188, and air supply line 154. The three ports of valve 158 included exhaust port 184, line 186, and air supply line 154.

In the centered or default position, valve 156 has porting configuration 190 in the active position. Springs 160 and 164 maintain porting configuration 190 in the active position until either solenoid 162 or 166 is powered. When power is applied to solenoid 162, the force of springs 160 and 164 is overcome and porting configuration 194 is moved to the active position. Similarly, if solenoid 166 is powered, porting configuration 192 is moved to the active position. Porting configuration 194 connects air supply line 154 with line 188 which connects to left side 114 of diaphragm chamber 106. Porting configuration 192 connects line 188 with exhaust port 196 to exhaust any air present in line 188 to the atmosphere. Porting configuration 190, which is the default configuration, leaves all ports closed.

Similarly, in the centered position, valve 158 has porting configuration 178 in the active position. Springs 168 and 172 maintain porting configuration 178 in the active position until either solenoid 170 or 174 is powered. When power is applied to solenoid 170, the force of springs 172 and 168 is overcome and porting configuration 182 is moved to the active position. Similarly, if solenoid 174 is powered, porting configuration 180 is moved to the active position. Porting configuration 180 connects air supply line 154 with line 186 which connects to right side 122 of diaphragm chamber 108. Porting configuration 182 connects line 186 with exhaust port 184 to exhaust any air present in line 186 to the atmosphere. Porting configuration 178, which is the default configuration, leaves all ports closed.

Valve 206 is a two port, two position solenoid valve with spring return. In the default position, spring 208 maintains porting configuration 214 in the active position. When solenoid 210 is powered, the force of spring 208 is overcome and porting configuration 212 is moved to the active position. Porting configuration 212 connections lines 216 and 218. Porting configuration 214 leaves lines 216 and 218 closed.

Figure 8:
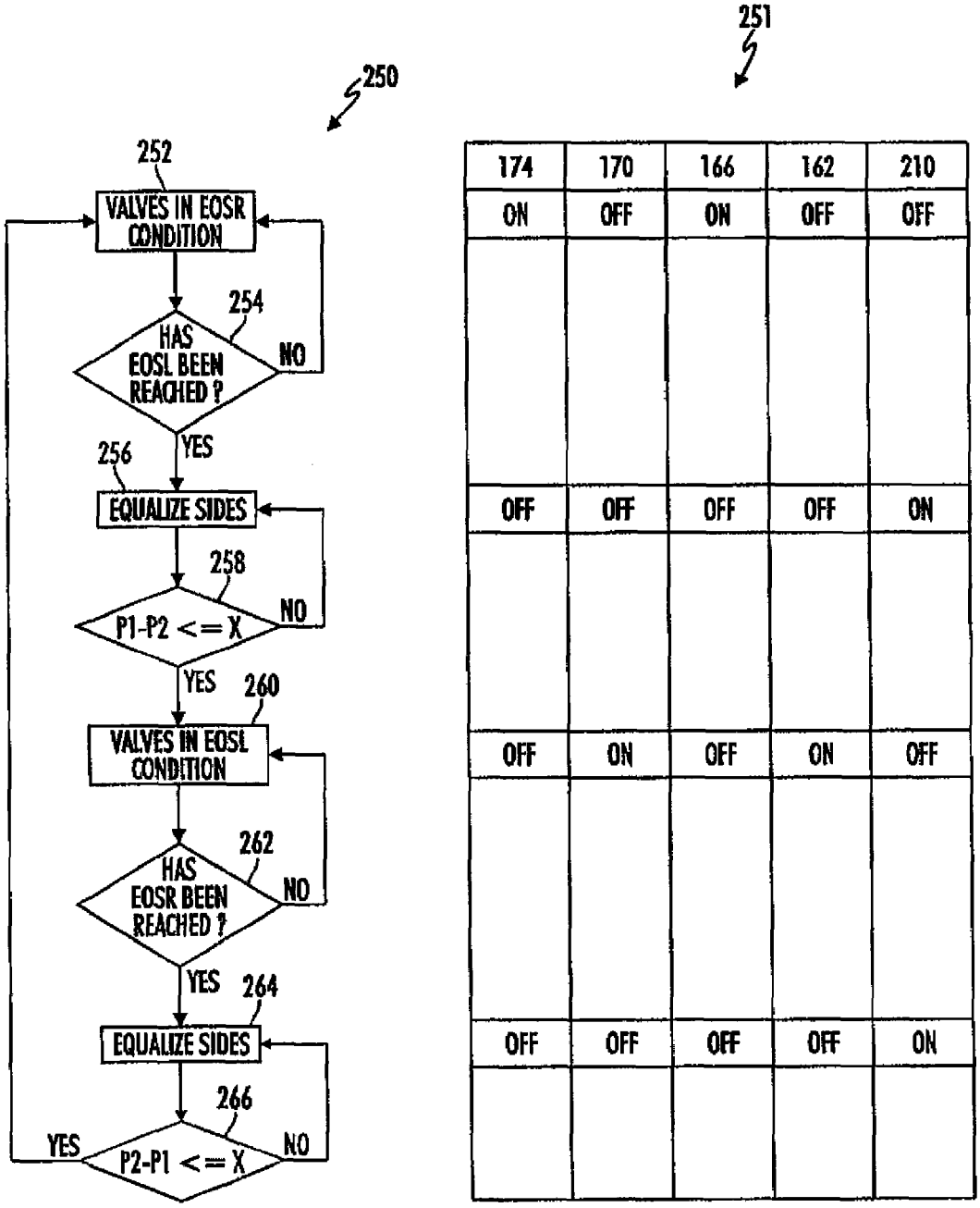
FIG. 8 is a flowchart and a logic table describing a method of operating the AOD pump shown in FIGS. 4-7.

FIG. 8 includes a flowchart 250 and a corresponding table 251 that illustrate a method of operating pump 100. When the diaphragms 110 and 118 are moving leftward and the valves are in the end-of-stroke right (EOSR) position as shown in FIG. 4, solenoids 174 and 166 are energized by controller 146 as shown by step 252. When solenoids 174 and 166 are energized, valve 158 has porting configuration 180 in the active position and valve 156 has porting configuration 192 in the active position. During this step, compressed air from air supply 104 is delivered to right side 122 of diaphragm chamber 108 through line 154, valve 158, and line 186. Increasing air pressure in right side 122 of diaphragm chamber 108 forces diaphragm 118 leftward. As diaphragm 118 moves leftward, connecting rod 116 pulls diaphragm 110 leftward in diaphragm chamber 106. Moving diaphragm 118 leftward forces fluid in left side 120 of diaphragm chamber 108 through line 193 and check valve 200 to fluid discharge line 102. Check valve 205 in line 196 is similar to check valve 61 in FIG. 1 in that it prevents fluid in left side 120 from being pushed back into line 196 during leftward movement of diaphragm 118. At the same time, moving diaphragm 110 leftward applies fluid suction to line 198, which in turn pulls fluid through check valve 203 and line 199 from fluid source 105 filling right side chamber 112 of diaphragm chamber 106. Check valve 201 in line 195 is similar to check valve 65 in FIG. 1 in that it prevents fluid in line 195 from being pulled back into right side 112 of diaphragm chamber 106 during leftward movement of diaphragm 110.

In step 254, diaphragm 110 contacts control rod 132 of pilot valve 124 indicating that the pump has reached end-of-stroke left condition (EOSL). Control rod 132 moves porting configuration 128 into the active position of pilot valve 124. In porting configuration 128, air from line 144 is exhausted to exhaust port 130 and air from air supply 140 is supplied to line 142. Air in line 142 causes sensor 134 to generate an end-of-stroke left signal which is carried through line 141 to controller 146. When an end-of-stroke left condition is detected the method moves forward to step 256.

Figure 5:
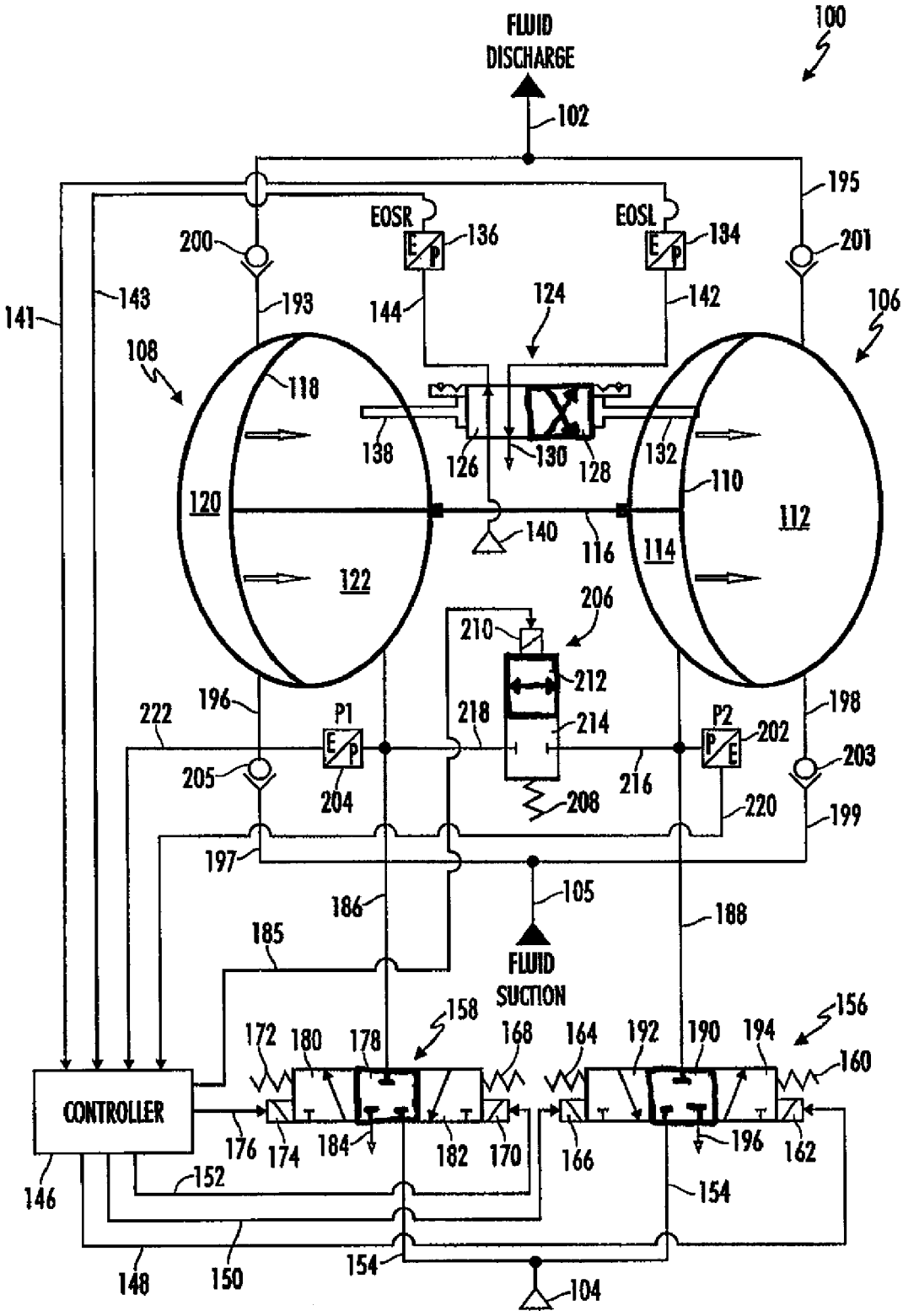
FIG. 5 is a schematic illustrating the AOD pump shown in FIG. 4.

Referring now to FIG. 5, in step 256, solenoids 174 and 166 are deactivated or turned off which causes porting configuration 178 in valve 158 and porting configuration 190 in valve 156 to be moved to the active position in the respective valves. Also, in step 256, solenoid 210 is energized to move porting configuration 212 to the active position of valve 206. Porting configuration 212 connected lines 216 and 218. During step 256, air present in right side 122 of diaphragm chamber 108 is transported through lines 186, 218, valve 206, line 216, and line 188 to left side 114 or diaphragm chamber 106. The air pressure P1 in right side 122 and the air pressure P2 in left side 114 begin to equalize as sensors 204 and 202 monitor the pressure change in right side 122 and left side 114. In step 258, the measured pressure P1 in right side 122 of diaphragm chamber 108 is compared to the measured pressure P2 of left side 114 of diaphragm chamber 106. When the difference between P1 and P2 is less than or equal to a user selectable pressure X, the method continues forward to step 260. In alternative embodiments the function of sensors 202 and 204 can be performed by a single differential pressure sensor.

Figure 6:
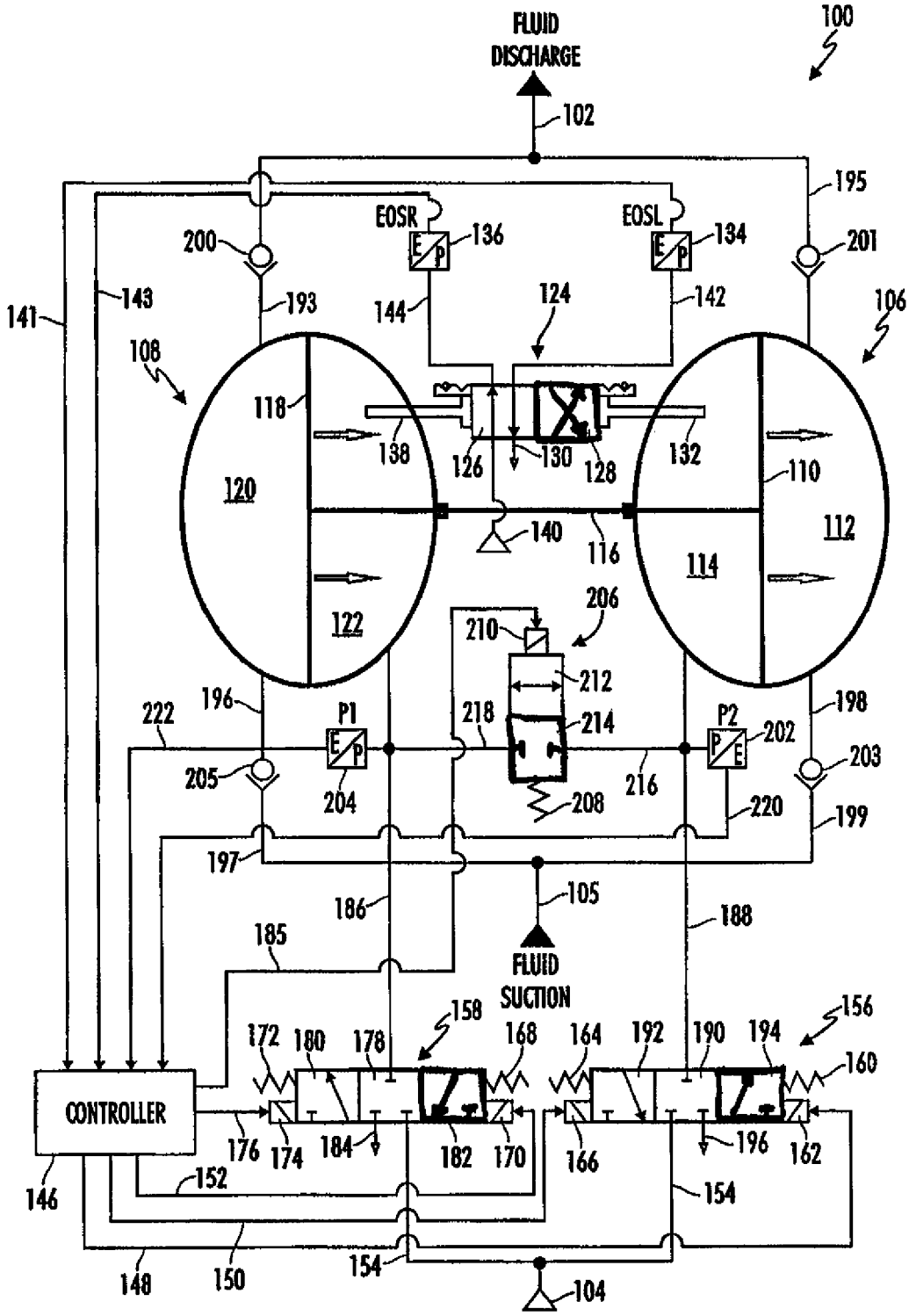
FIG. 6 is a schematic illustrating the AOD pump shown in FIG. 4.

Referring now to FIGS. 6 and 8, solenoids 170 and 162 are energized and all other solenoids are deactivated. Porting configuration 182 is moved to the active position in valve 158 and porting configuration 194 is moved to the active position in valve 156. When solenoid 210 is deactivated in valve 206, spring 208 moves porting configuration 214 into the active position in which lines 216 and 218 are closed. In this condition the valves are in an end-of-stroke left configuration in which compressed air from air supply 104 is transported from supply line 154 through valve 156 to line 188 to left side 114 of diaphragm chamber 106. At the same time any remaining air in right side 122 of diaphragm chamber 108 is exhausted through line 186 and valve 158 to exhaust port 184. As the increase in air pressure moves diaphragm 110 rightward in diaphragm chamber 106, fluid present in right side 112 is forced out of diaphragm chamber 106 through line 195 and check valve 201 to fluid discharge line 102. Check valve 203 in line 198 is similar to check valve 63 in FIG. 1 in that it prevents fluid in right side 112 from being pushed back into line 199 during rightward movement of diaphragm 110. At the same, rod 116 pulls diaphragm 118 rightward which creates a vacuum in left side 120 of diaphragm chamber 108. Fluid is received in left side 120 from fluid supply line 105 and line 197. Check valve 200 in line 193 is similar to check valve 62 in FIG. 1 in that it prevents fluid in line 193 from being pulled back into left side 120 during rightward movement of diaphragm 118.

Figure 7:
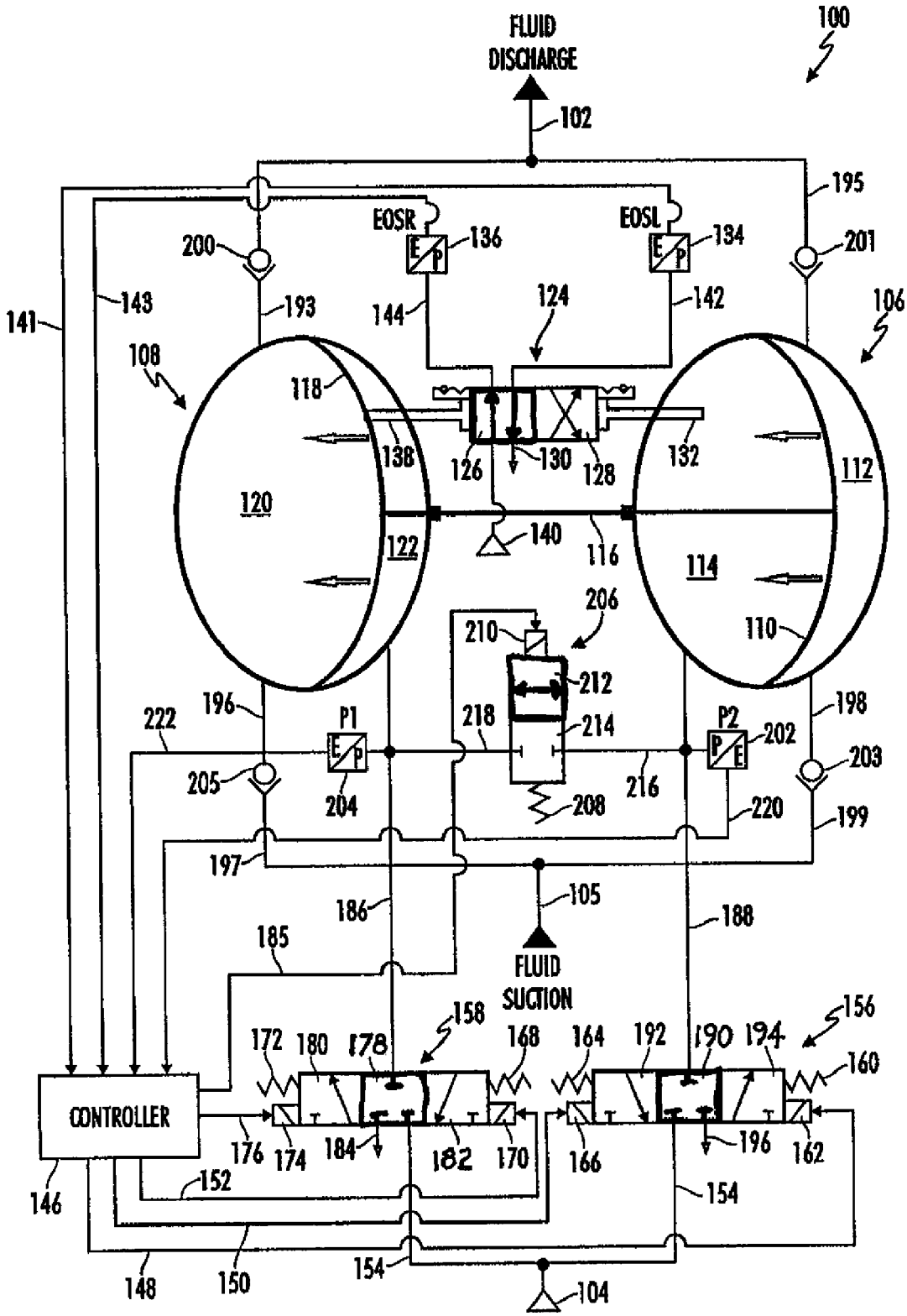
FIG. 7 is a schematic illustrating the AOD pump shown in FIG. 4.

When diaphragms 118 and 110 reach the end-of-stroke right position in step 262, as shown in FIG. 7 the method advances to step 264. In step 264, the pressure in right side 122 and left side 114 of the respective chambers is equalized and all solenoids except solenoid 210 are deactivated. Solenoid 210 is energized to move porting configuration 212 to the active position of valve 206. Compressed air from left side 114 of diaphragm chamber 106 is transported through lines 188 and 216, valve 206, and lines 218 and 186 to right side 122 of diaphragm chamber 108 until the difference in pressures P1 and P2 is less than or equal to the user specified pressure X as shown in step 266. When the pressure differential is less than or equal to pressure X, the method returns to step 252 and repeats.

Figure 9:
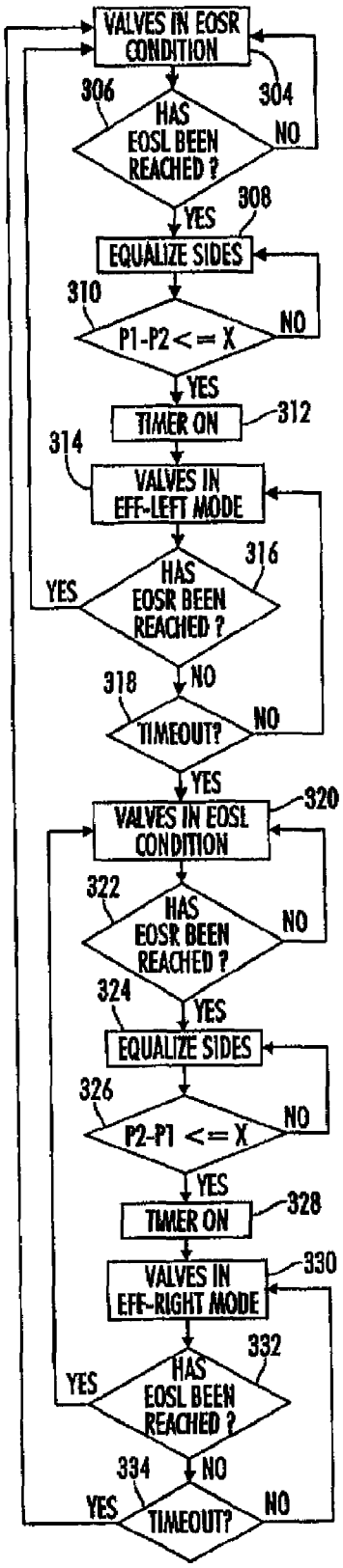
FIG. 9 is a flowchart and a logic table describing a method of operating the AOD pump shown in FIGS. 10-14.
Figure 10:
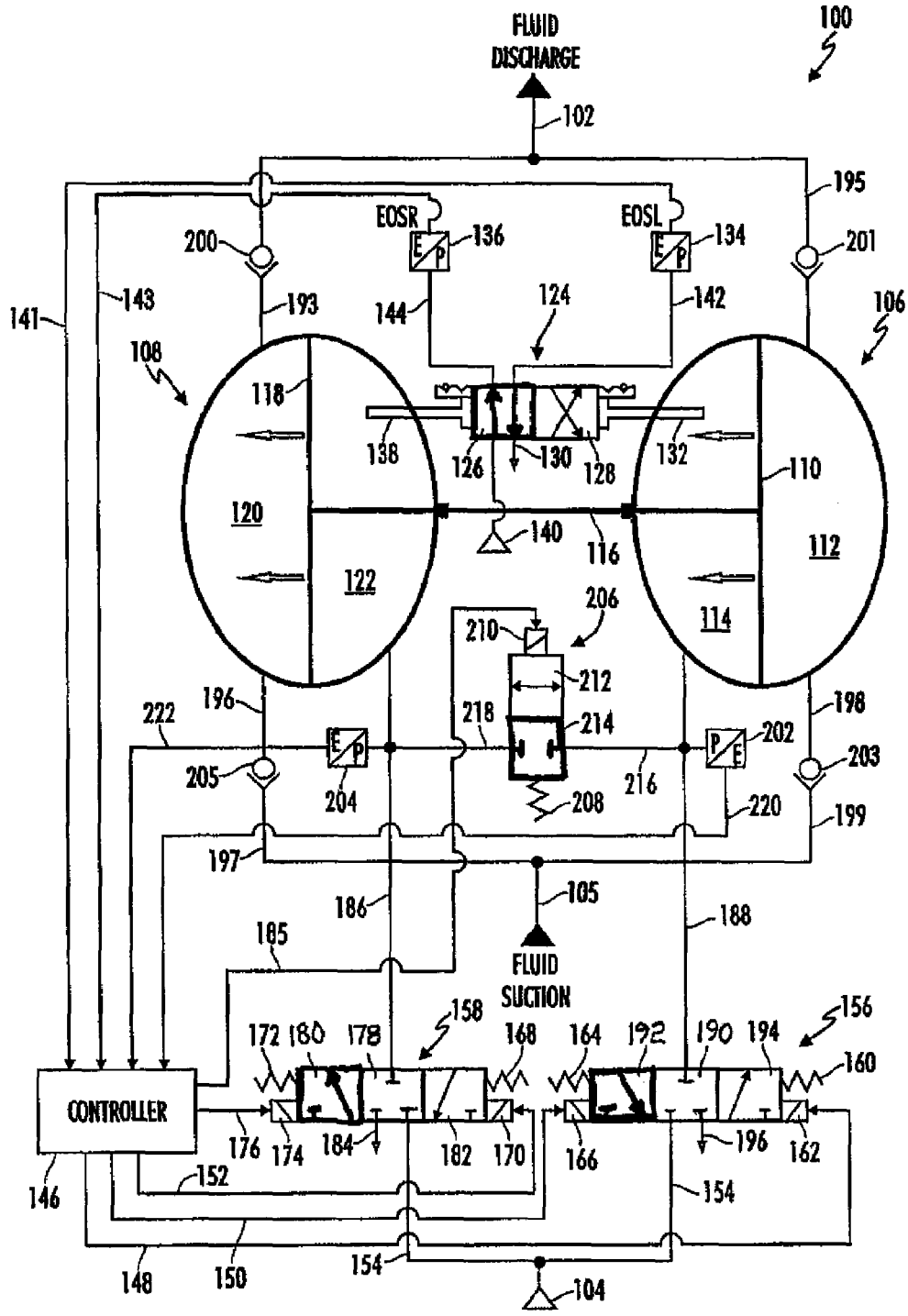
FIG. 10 is a schematic illustrating another embodiment of a AOD pump.

Another method of operating AOD pump 100 is shown in FIGS. 9-14. FIG. 9 includes a flowchart 300 and a corresponding table 302 illustrating solenoid status during the steps of the method. In step 304, the valves are locked in the end-of-stroke right condition and the diaphragms 118 and 110 are moving leftward as shown in FIG. 10. As shown in table 302, solenoids 174 and 166 are energized to position porting configurations 180 and 192 in the active positions in valves 158 and 156. Compressed air is being supplied to right side 122 of diaphragm chamber 108 and air in left side chamber 114 of diaphragm chamber 106 is being exhausted through exhaust port 196. Fluid present in left side 120 of diaphragm chamber 108 is pushed through line 193 and check valve 200 to fluid discharge line 102. Check valve 205 in line 197 prevents fluid flow from left side 120 back into line 196 during leftward movement of diaphragm 118. At the same time, fluid is pulled from fluid suction line 105, line 199, check valve 203, and line 198 into right side 112 of diaphragm chamber 106 during leftward movement of diaphragm 110. Check valve 201 prevent fluid in line 195 from being pulled back into right side 112 during leftward movement of diaphragm 110.

Figure 11:
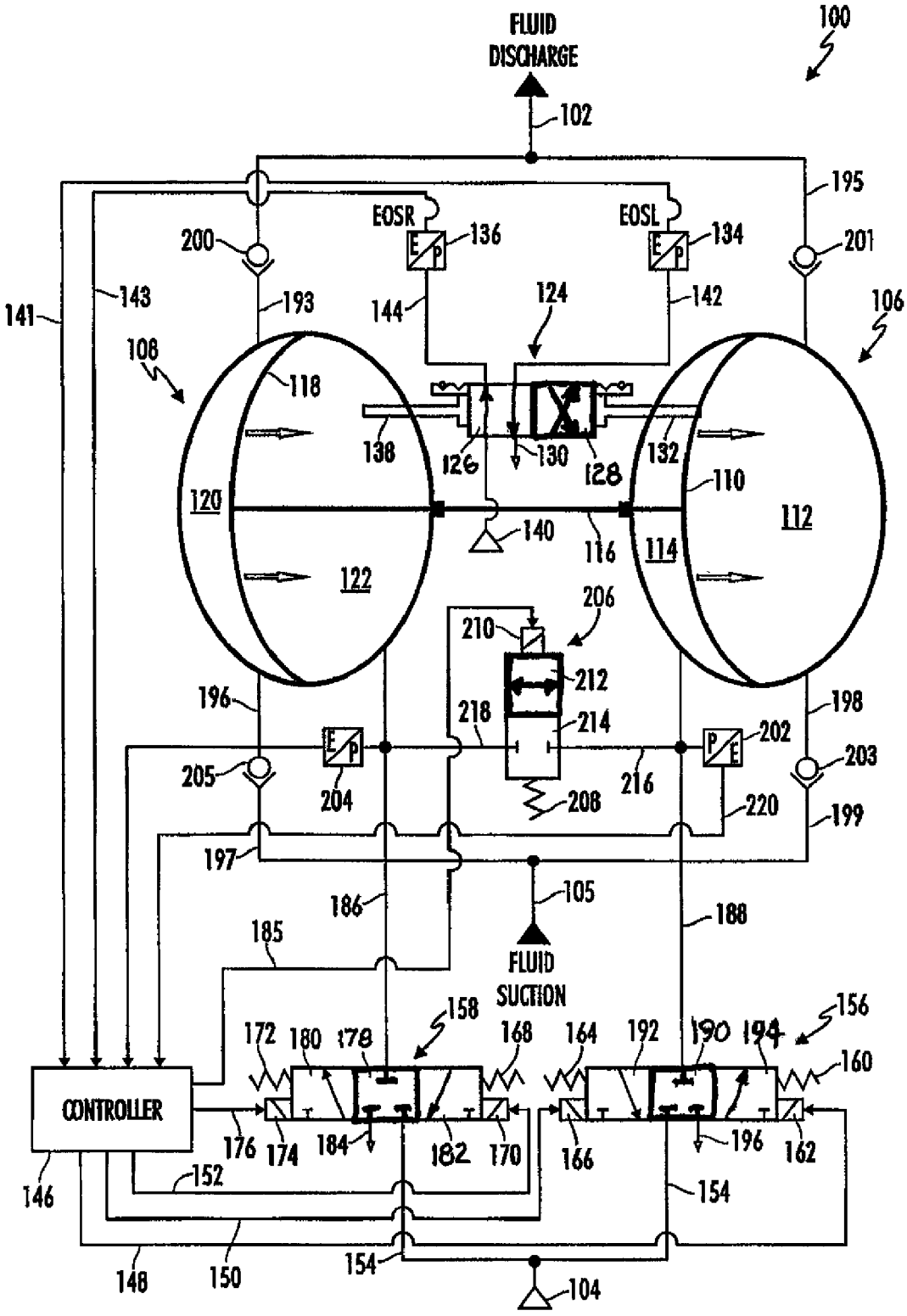
FIG. 11 is a schematic illustrating the AOD pump shown in FIG. 10.

When diaphragm 110 contacts control rod 132 porting configuration 128 is moved and locked into the active position in pilot valve 124 as shown in FIG. 11. Compressed air is supplied to sensor 134 which then sends an electrical signal to controller 146 that diaphragm 118 and 110 have reached the end-of-stroke left position. In step 306, when the diaphragms have reached the end-of-stroke left position the method advances to step 308.

In step 308, the air pressure in the right side 122 of diaphragm chamber 108 and left side 114 of diaphragm chamber 106 is equalized. As shown in table 302, solenoid 210 is energized (not shown in FIG. 11) and all other solenoids are deactivated. When solenoid 210 is energized, porting configuration 212 is moved to the active position in valve 206 to allow air in right side 122 to flow through lines 186 and 218, valve 206, and lines 216 and 188 to left side 114 of diaphragm chamber 106. In step 310, sensors 204 and 202 sense the air pressure P1 in right side 122 of diaphragm chamber 108 and the air pressure P2 in left side 114 of diaphragm chamber 106 and send corresponding signals to controller 146. Controller 146 then compares the difference in pressures P1 and P2 to a predetermined user selectable pressure X. When the difference between P1 and P2 is less than or equal to X, the method advances to step 312.

Figure 12:
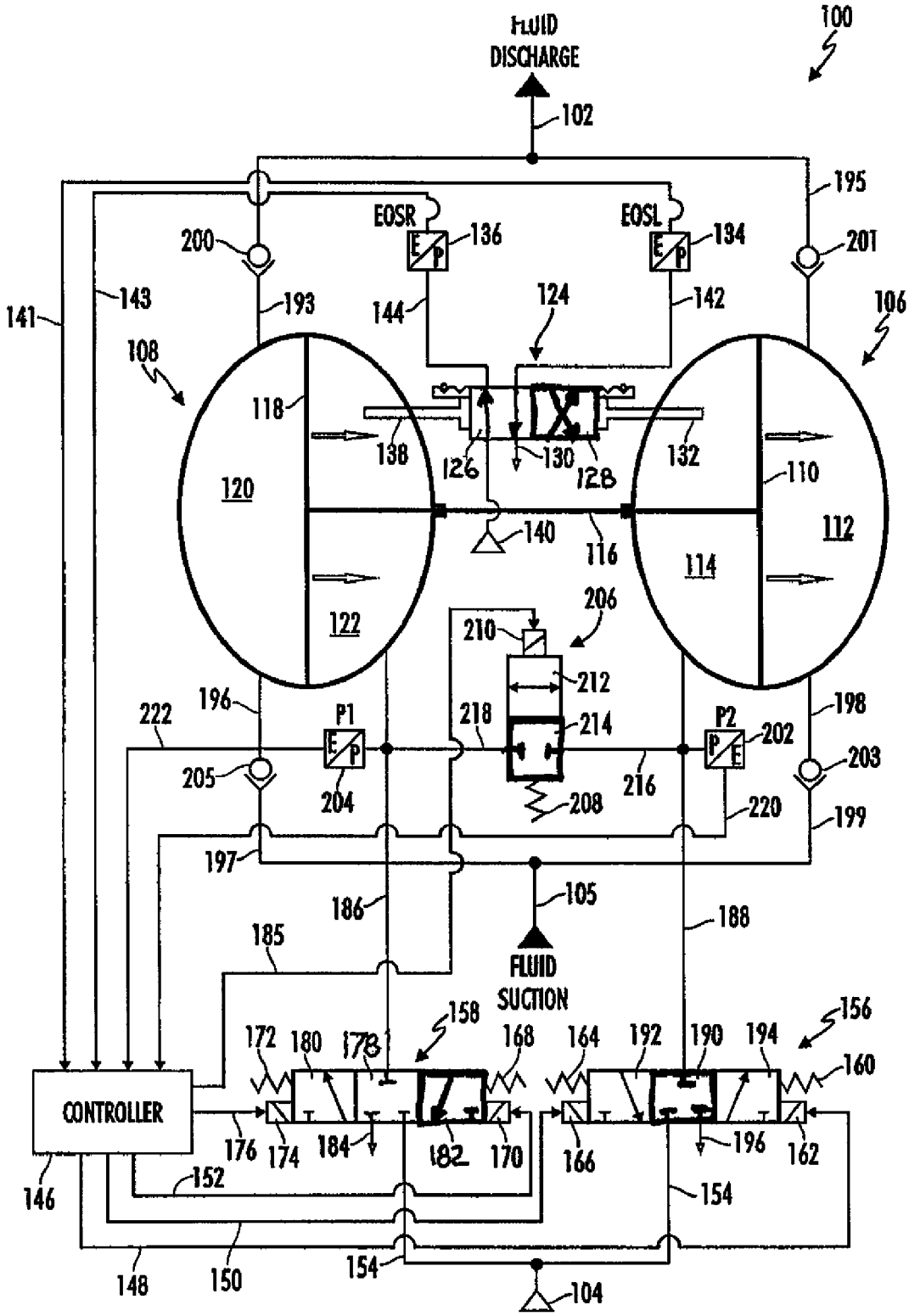
FIG. 12 is a schematic illustrating the AOD pump shown in FIG. 10.

In step 312, controller 146 starts a timer (not shown) and advances to step 314. In step 314, the valves are configured in the efficiency-left mode (EFF-LEFT) where solenoid 170 is energized and all other solenoids are deactivated as shown in FIG. 12 and table 302. Energizing solenoid 170 moves porting configuration 182 to the active position of valve 158. In this configuration, air in left side 114 of diaphragm chamber 106 expands and moves diaphragms 110 and 118 rightward as air in right side 122 of diaphragm chamber 108 is exhausted to the atmosphere through exhaust port 184 in valve 158. In step 316, if diaphragms 118 and 110 reach the end-of-stroke right condition, the method advances to 304 and begins again. If end-of-stroke right is not reached, the method advances to step 318. In step 318, the amount of time recorded by the timer started in step 312 is compared to a user selectable timeout period, for example 1.5 seconds. If the timer has timed out, reached 1.5 seconds for this example, the method-advances to step 320. If the timer has not yet reached the timeout period, 1.5 seconds for this example, the method returns to step 314 to allow the air in left side 114 of diaphragm chamber 106 to continue to expand.

In step 320, valves 156 and 158 are placed in the end-of-stroke left configuration by energizing solenoids 170 and 162 to move porting configurations 182 and 194 into the active positions in valves 158 and 156 as shown in table 302 (not shown in FIG. 12). In this condition, compressed air from air supply 104 is supplied to left side 114 of diaphragm chamber 106 to move diaphragms 110 and 118 rightward. As diaphragm 118 moves rightward, fluid is pulled into left side 120 through line 196, check valve 205, line 197, and fluid suction line 105. Check valve 200 in line 193 prevents fluid in line 102 from being pulled back into left side 120 when diaphragm 118 moves rightward. At the same time, diaphragm 110 moves rightward pushing fluid present in right side 112 of diaphragm chamber 106 through line 195 and check valve 201 to fluid discharge line 102. Check valve 203 in line 199 prevents fluid in right side 112 from being pushed back into line 199 during rightward movement of diaphragm 110.

Figure 13:
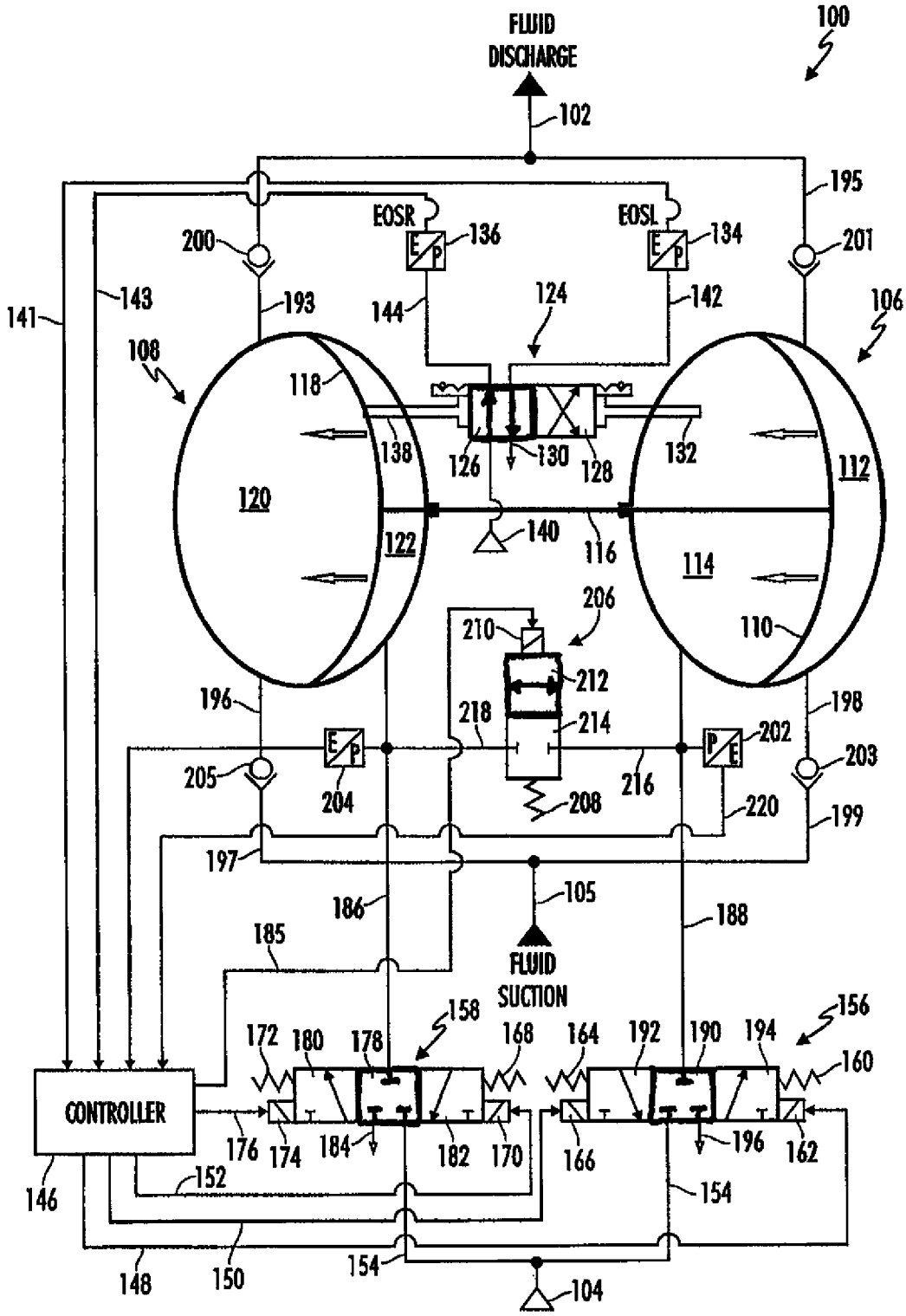
FIG. 13 is a schematic illustrating the AOD pump shown in FIG. 10.

In step 322, when an end-of-stroke right condition is detected the method advances to step 324. In step 324 the air pressure in left side 114 of diaphragm chamber 106 and right side 122 in diaphragm chamber 108 is equalized. In step 324, only solenoid 210 is energized and all other solenoids are deactivated as shown in FIG. 13. Energizing solenoid 210 moves porting configuration 212 to the active position of valve 206 to allow air in left side chamber 114 to flow through lines 188 and 216, valve 206, and lines 218 and 186 to right side chamber 122.

Figure 14:
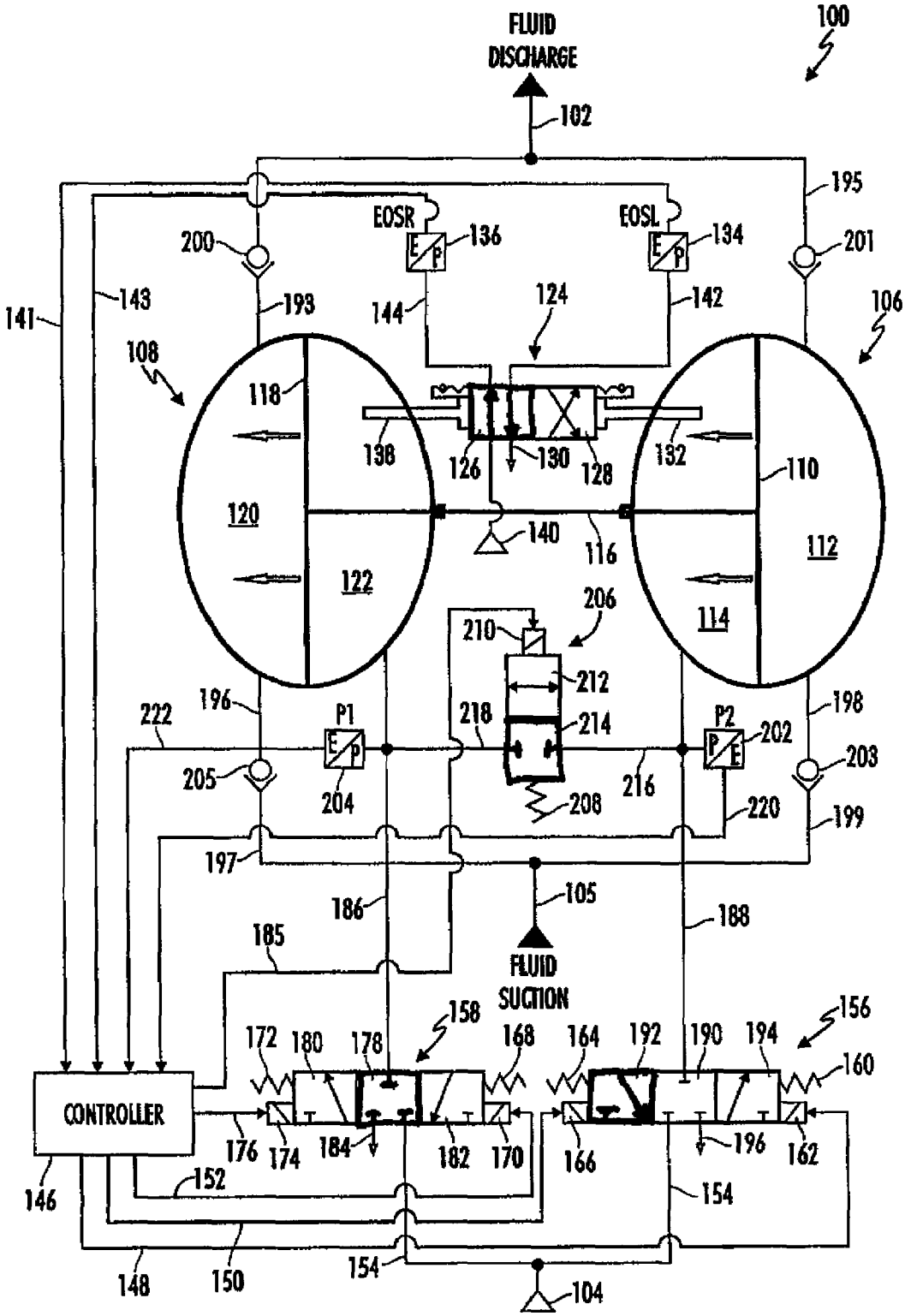
FIG. 14 is a schematic illustrating the AOD pump shown in FIG. 10.

In step 326, controller 146 compares the difference between pressures P2 in left side 114 and P1 in right side 122 to a user selectable pressure X. If the difference between P2 and P1 is less than or equal to X, the method advances to step 328 which activates a timer, similar to step 312. The method then advances to step 330. In step 330, the valves are positioned in the efficiency-right mode (EFF-RIGHT) as shown in FIG. 14 and table 302. In step 330, only solenoid 166 is energized and all other solenoids are deactivated. Solenoid 166 moves porting configuration 192 to the active position of valve 156 to vent air in left side 114 to the atmosphere through exhaust port 196. In this mode, air in right side 122 of diaphragm chamber 108 expands to move diaphragms 118 and 110 leftward. In step 332, if an end-of-stroke left signal is detected the method advances to step 320. If an end-of-stroke left signal is not detected the method advances to step 334, which is similar to step 318.

In step 334, which is similar to step 318, a user selectable timeout is compared to the timer started in step 328. If the timer has reached the timeout period the method advances to step 304 and begins again. If the timer has not reached the timeout period, the method returns to the step 330 to allow the air in right side 122 to continue to expand until either the end-of-stroke left condition has been reached the timer reaches the timeout period.

Figure 15:
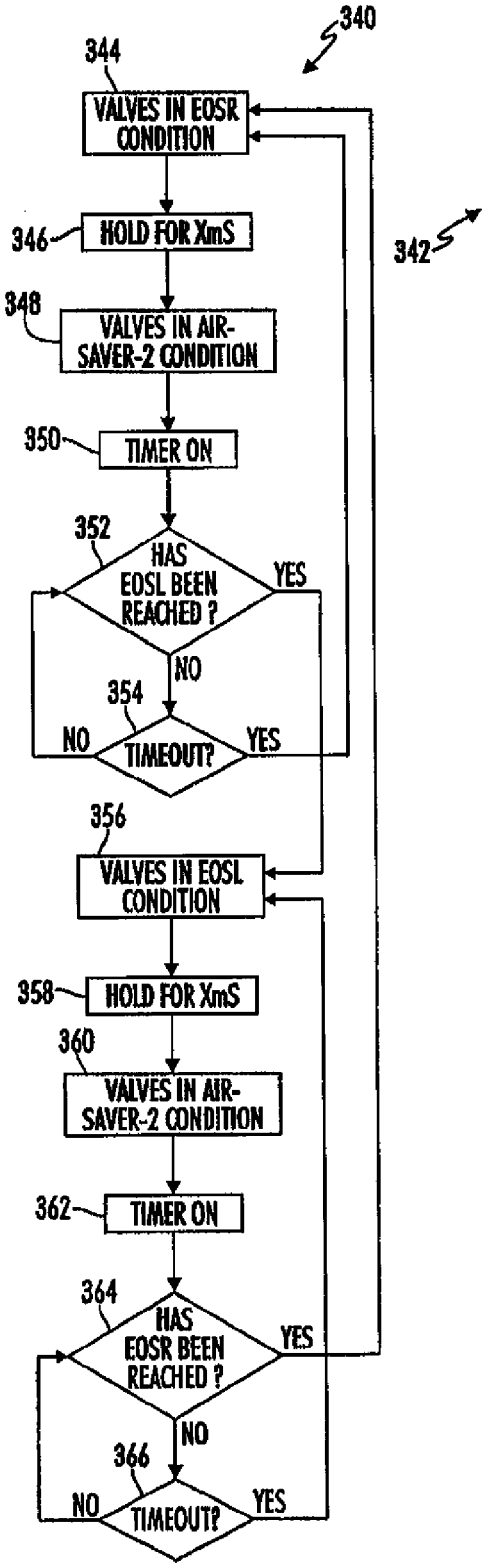
FIG. 15 is a flowchart and a logic table describing a method of operating the AOD pump shown in FIGS. 16-18.
Figure 16:
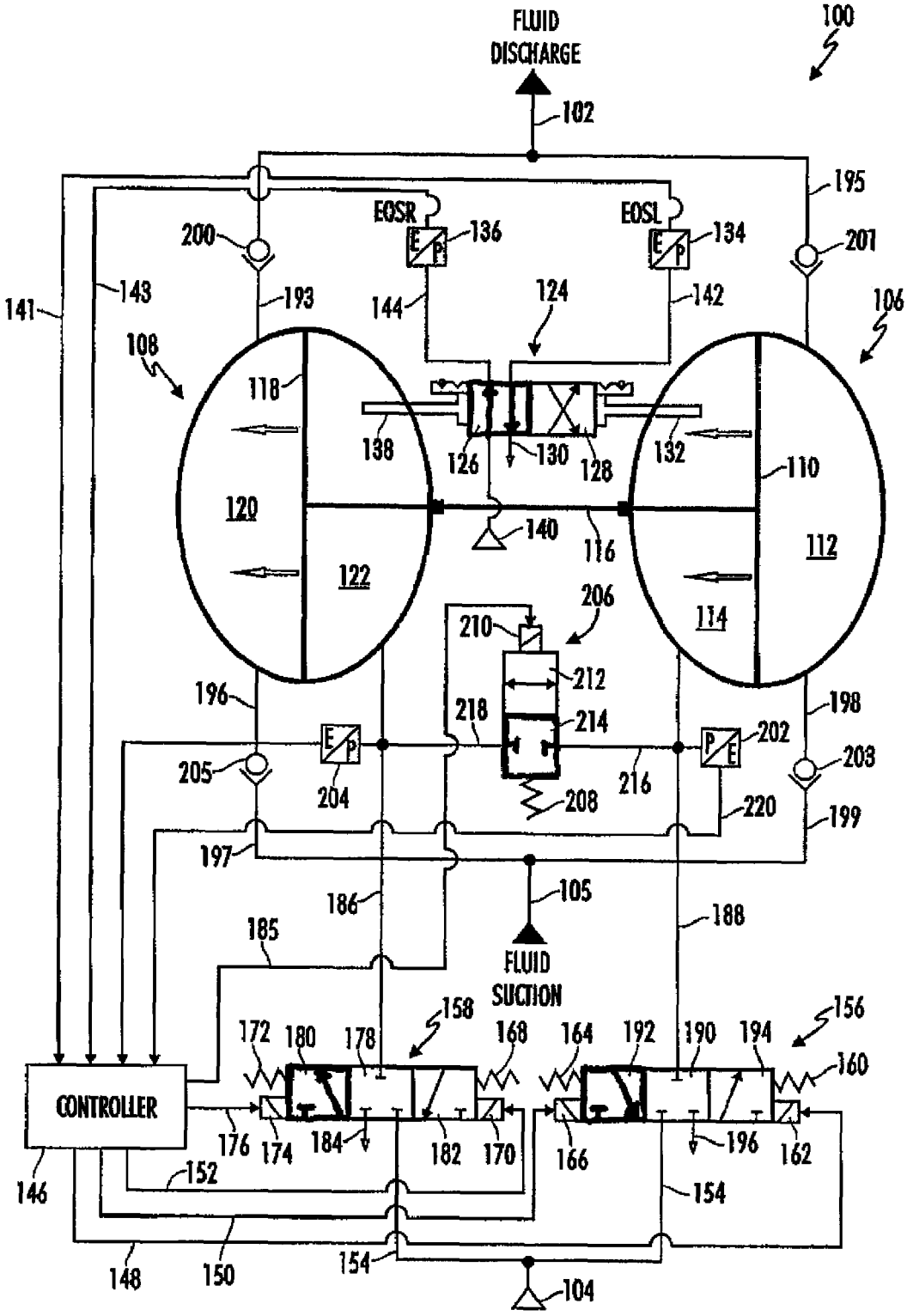
FIG. 16 is a schematic illustrating another embodiment of a AOD pump.

Another method of operating AOD pump 100 is shown in FIGS. 10-15. FIG. 15 includes a flowchart 340 and a corresponding table 342 illustrating the status of the solenoids during the steps of the method. In step 344, valves 156 and 158 are locked in the end-of-stroke right condition and the diaphragms 118 and 110 are moving leftward as shown in FIG. 16. Solenoids 174 and 166 are energized to position porting configurations 180 and 192 in the active positions in valves 158 and 156. Compressed air is being supplied to right side 122 of diaphragm chamber 108 and air in left side chamber 114 of diaphragm chamber 106 is being exhausted through exhaust port 196. Fluid present in left side 120 of diaphragm chamber 108 is pushed through line 193 and check valve 200 to fluid discharge line 102. Check valve 205 in line 197 prevents fluid from flow from left side 120 back into line 196 during leftward movement of diaphragm 118. At the same time, fluid is pulled from fluid suction line 105, line 199, check valve 203, and line 198 into right side 112 of diaphragm 106 during leftward movement of diaphragm 110. Check valve 201 prevent fluid in line 195 from being pulled back into right side 112 during leftward movement of diaphragm 110.

In step 346, the solenoids are energized for a user defined time period X milliseconds (mS). In step 348, the valves are placed in the Air-Saver 2 condition in which only solenoid 166 is energized and all other solenoids are deactivated (not shown). The Air-Saver 2 condition is similar to the efficiency-right mode described above. In step 348, air in right side 122 of diaphragm chamber 108 is expanding to force diaphragms 118 and 110 leftward. In step 350 a timer in controller 146 is activated and the method proceeds to step 352. If an end-of-stroke left signal is received by controller 146 from sensor 134 the method proceeds to step 356. If an end-of-stroke left signal is not received by controller 146 the method advances to step 354.

Figure 17:
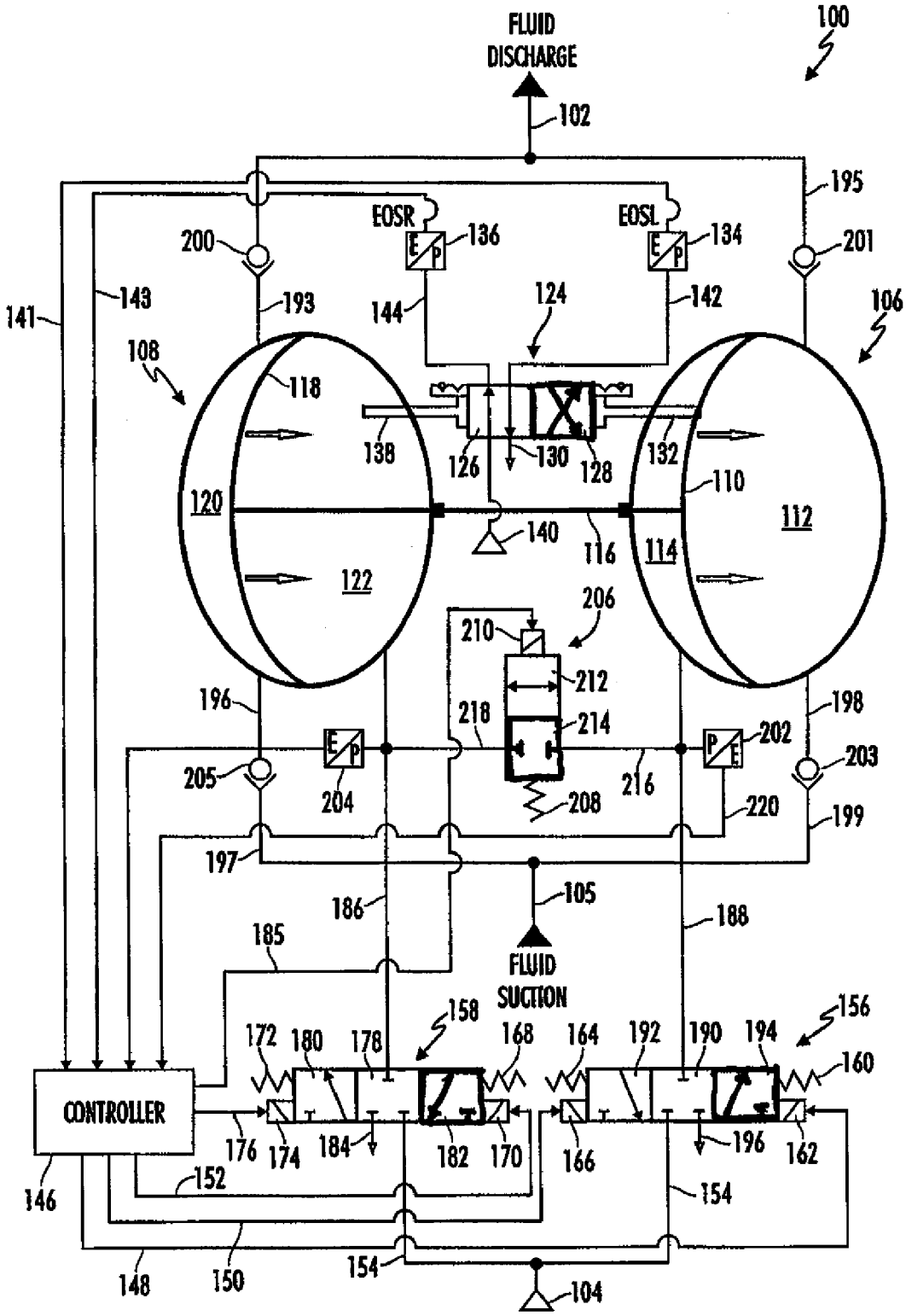
FIG. 17 is a schematic illustrating the AOD pump shown in FIG. 16.

In step 354, a user selectable timeout period is compared to the time elapsed as measured by the timer started in step 350. If the elapsed time period has reached the timeout period the method returns to step 344. If the timeout period has not expired the method returns to step 352. As discussed above, when an end-of-stroke left signal is received by controller 146 in step 352 the method advances to step 356. In step 356, the valves are in the end-of-stroke left condition as shown in FIG. 17. Solenoids 170 and 162 are energized to position porting configurations 182 and 194 in the active positions in valves 158 and 156. Compressed air is supplied to left side 114 of diaphragm chamber 106 to force diaphragms 110 and 118 rightward. As diaphragm 118 moves rightward, fluid is pulled into left side 120 through line 196, check valve 205, line 197, and fluid suction line 105. Check valve 200 in line 193 prevent fluid in line 193 from being pulled back into left side 120 when diaphragm 118 moves rightward. At the same time, diaphragm 110 moves rightward pushing fluid present in right side 112 of diaphragm chamber 106 through line 195 and check valve 201 to fluid discharge line 102. Check valve 203 in line 199 prevents fluid in right side 112 from being pushed back into line 199 during rightward movement of diaphragm 110.

Figure 18:
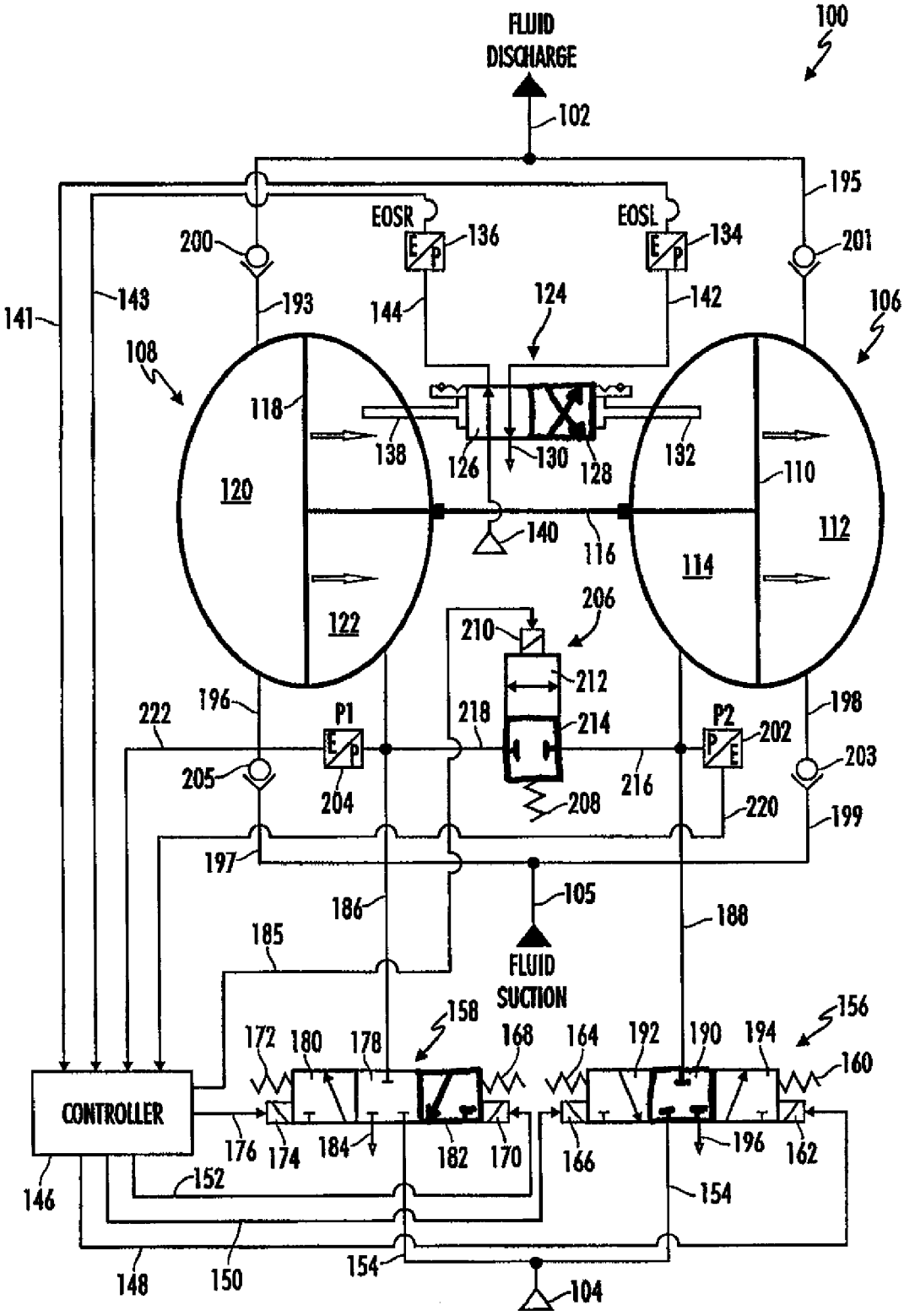
FIG. 18 is a schematic illustrating the AOD pump shown in FIG. 16.

In step 358, the solenoids are energized for a user defined time period X milliseconds (mS). In step 360, the valves are placed in the Air Saver 2 condition in which only solenoid 170 is energized to move porting configuration 182 into the active position of valve 158 as shown in FIG. 18. In the Air Saver 2 condition compressed air present in left side 114 of diaphragm chamber 106 expands to force diaphragms 110 and 118 rightward. In step 362, a timer in controller 146 is initiated. In step 364, if an end-of-stroke right signal is received by controller 146 from sensor 136 the method returns to step 344 to start the cycle over again. If an end-of-stroke right signal is not received by controller 146, the method advances to step 366. In step 366, the time elapsed since the timer was activated in step 362 is compared to a user selectable timeout period. If the elapsed time recorded by the time exceeds the timeout period the method proceeds back to step 356. If the timeout period has not expired the method returns to step 364.

Figure 19:
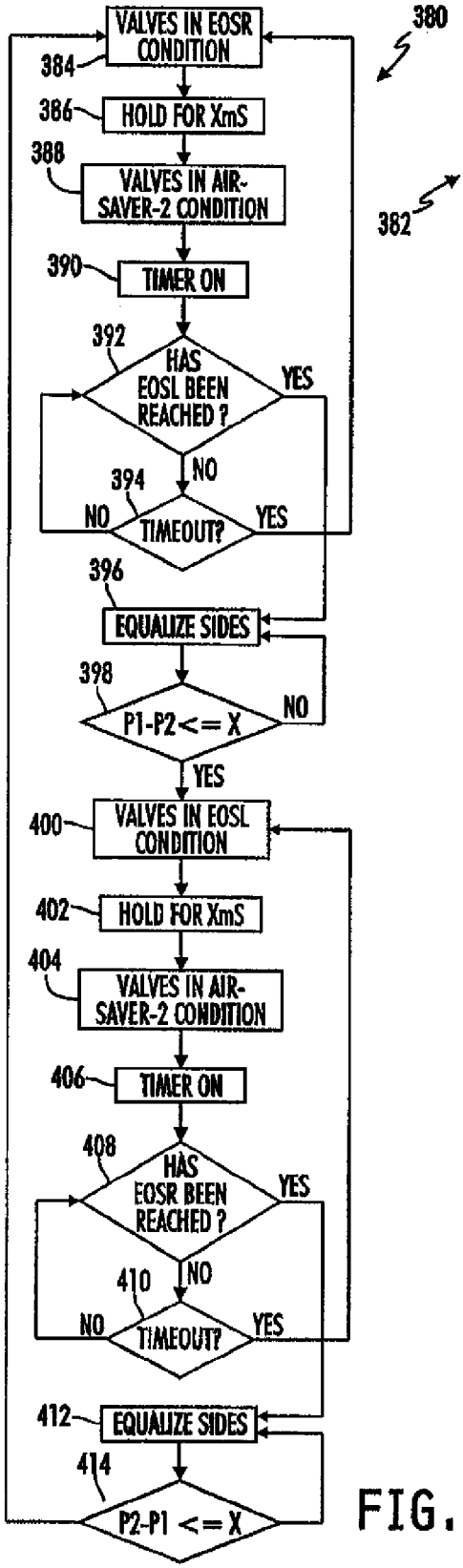
FIG. 19 is a flowchart and a logic table describing a method of operating the AOD pump shown in FIGS. 20-23.
Figure 20:
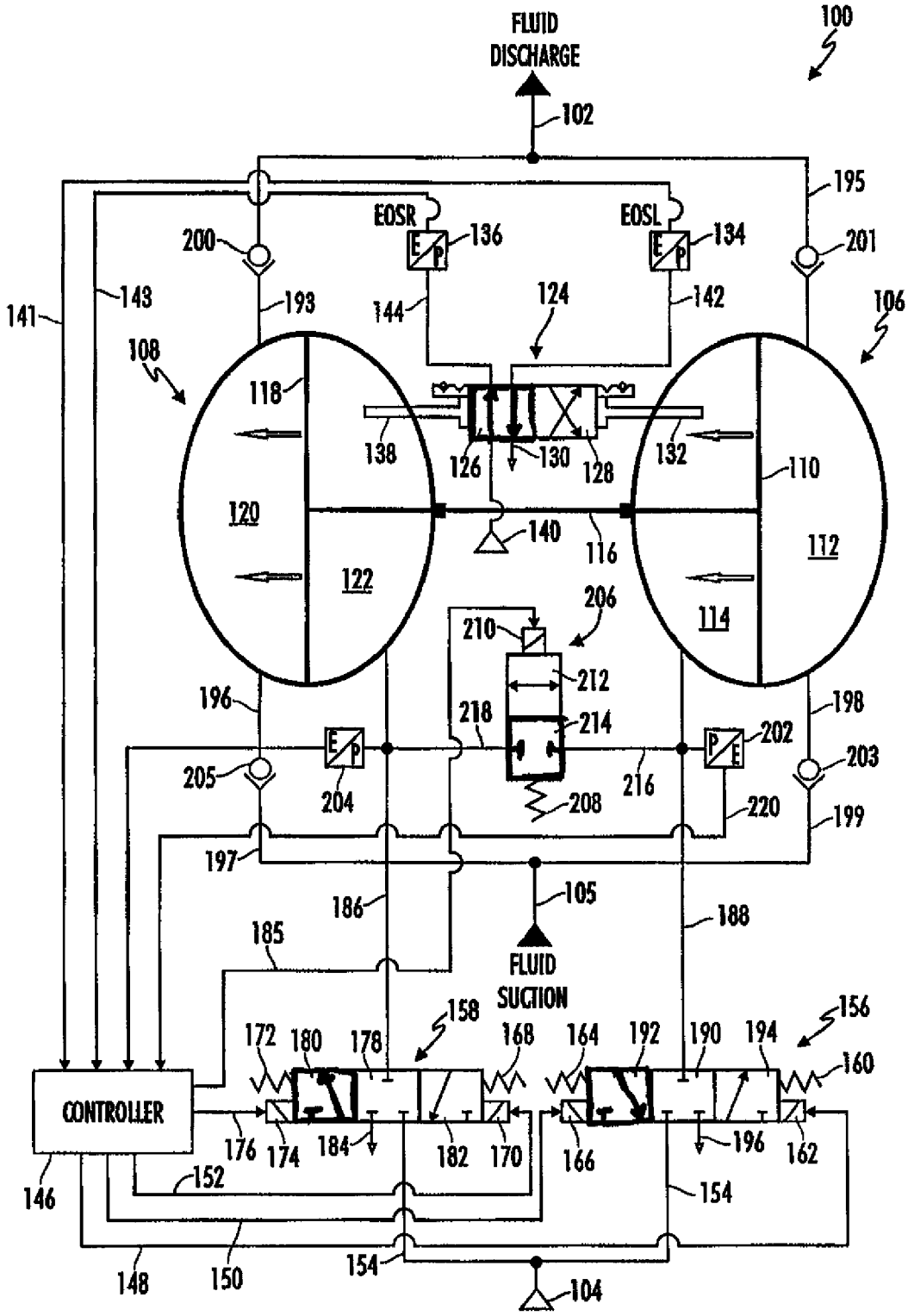
FIG. 20 is a schematic illustrating another embodiment of a AOD pump.

Another method of operating AOD pump 100 is shown in FIGS. 19-23. FIG. 19 includes a flowchart 380 and a corresponding table 382 illustrating the status of the solenoids during the steps of the method. In step 384, the valves are locked in the end-of-stroke right condition and the diaphragms 118 and 110 are moving leftward as shown in FIG. 20. Solenoids 174 and 166 are energized to position porting configurations 180 and 192 in the active positions in valves 158 and 156. Compressed air is being supplied to right side 122 of diaphragm chamber 108 and air in left side 114 of diaphragm chamber 106 is being exhausted through exhaust port 196. Fluid present in left side 120 of diaphragm chamber 108 is pushed through line 193 and check valve 200 to fluid discharge line 102. Check valve 205 in line 197 prevents fluid flow from left side 120 back into line 196 during leftward movement of diaphragm 118. At the same time, fluid is pulled from fluid suction line 105, line 199, check valve 203, and line 198 into right side 112 of diaphragm chamber 106 during leftward movement of diaphragm 110. Check valve 201 prevent fluid in line 195 from being pulled back into right side 112 during leftward movement of diaphragm 110.

In step 386 the solenoids are energized for a user defined time period X milliseconds (mS). In step 388 the valves are placed in the Air-Saver 2 condition in which only solenoid 166 is energized (not shown in FIG. 20) and all other solenoids are deactivated as shown in Table 382. Step 388 is similar to step 348 in that air in right side 122 of diaphragm chamber 108 is expanding to force diaphragms 118 and 110 leftward. In step 390 a timer in controller 146 is activated and the method proceeds to step 392. In step 392, if an end-of-stroke left signal is received by controller 146 from sensor 134 the method proceeds to step 396. If an end-of-stoke left signal is not received by controller 146 the method advances to step 394.

Figure 21:
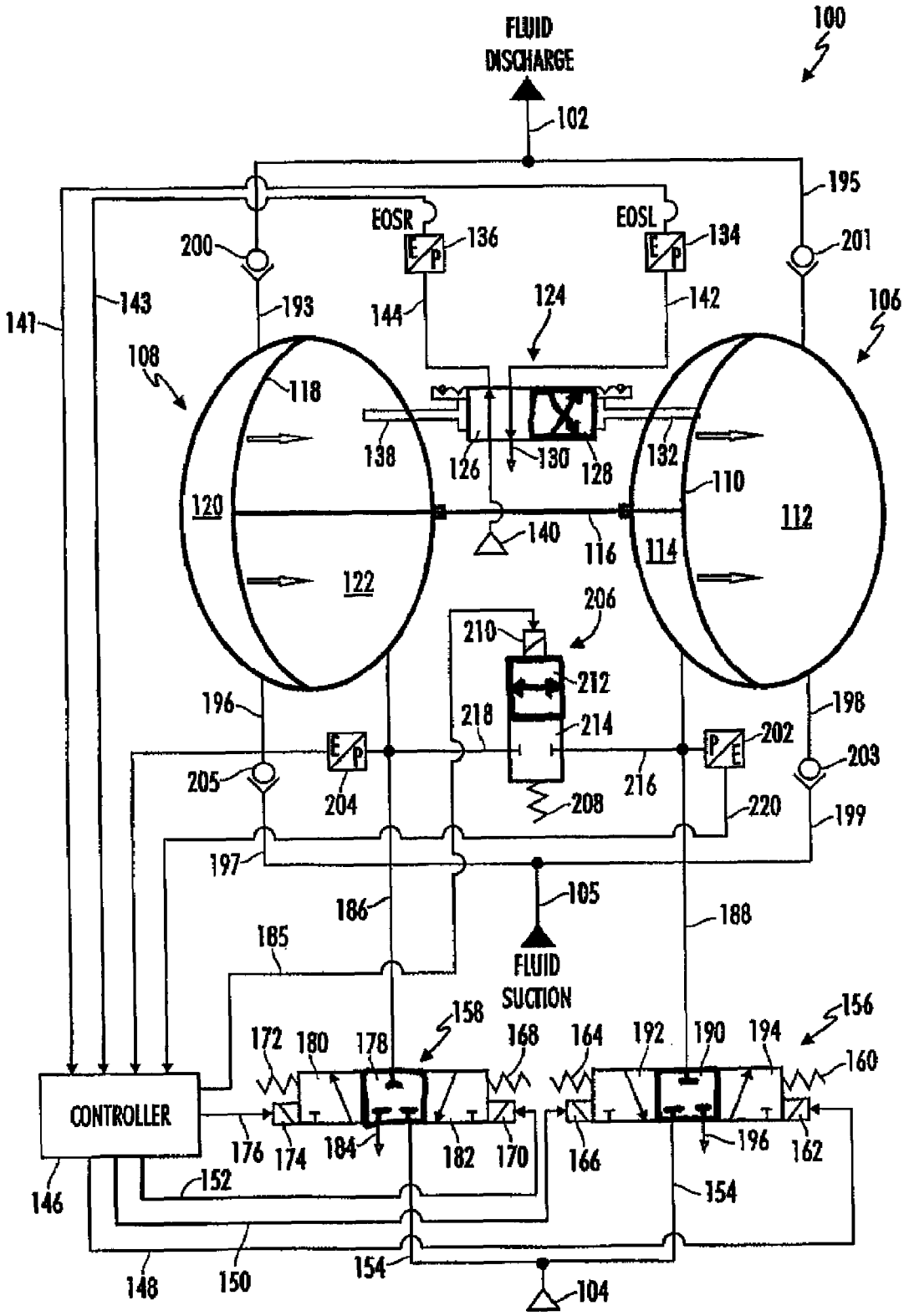
FIG. 21 is a schematic illustrating the AOD pump shown in FIG. 20.

In step 394, a user selectable timeout period is compared to the time elapsed as measured by the timer started in step 390. If the elapsed time period has reached the timeout period the method returns to step 384. If the timeout period has not expired the method returns to step 392. As discussed above, when an end-of-stroke left signal is received by controller 146 in step 392 the method advances to step 396. In step 396, as shown in FIG. 21, the air pressure in right side 122 of diaphragm chamber 108 is equalized with the air pressure in left side 114 of diaphragm chamber 106. Solenoid 210 of valve 206 is energized to allow air in right side 122 to flow through lines 186 and 218, valve 206, and lines 216 and 188 to left side 114 of diaphragm chamber 106. In step 398, the air pressure P1 of right side 122 is measured by sensor 204 and monitored by controller 146. The air pressure P2 of left side 114 is measured by sensor 202 which sends a corresponding signal to controller 146. Controller 146 then compares the difference between P1 and P2 with a predetermined user defined air pressure X. If the difference between P1 and P2 is less than or equal to X the method advances to step 400. If the difference between P1 and P2 is greater than X the method returns to step 396.

Figure 22:
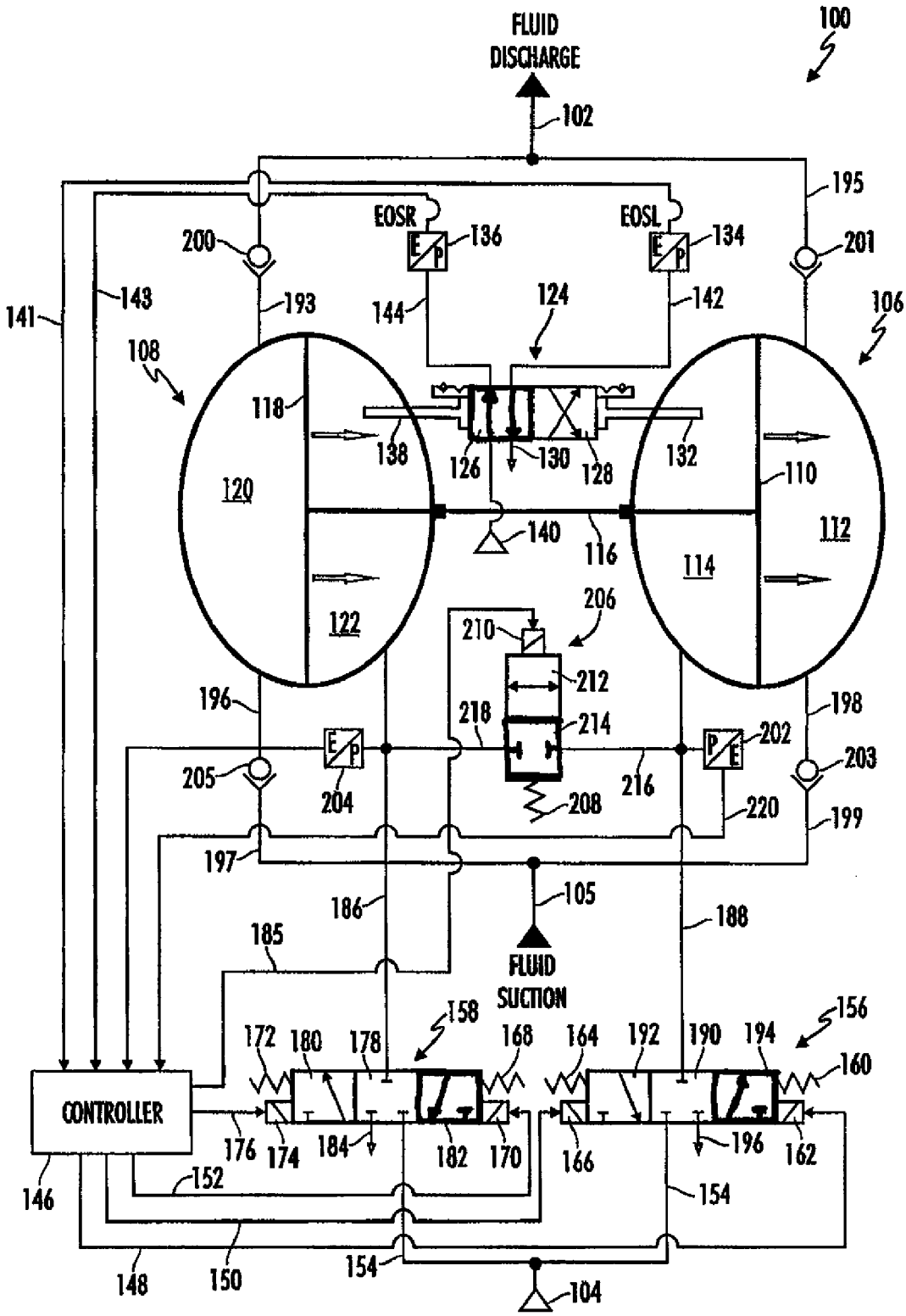
FIG. 22 is a schematic illustrating the AOD pump shown in FIG. 20.

In step 400, the valves are in the end-of-stroke left condition with solenoids 170 and 162 energized to move porting configurations 182 and 194 into the active positions of valves 158 and 156 as shown in FIG. 22. Compressed air is being supplied to left side 114 of diaphragm chamber 106 and air in right side 122 of diaphragm chamber 108 is being exhausted through exhaust port 184. Fluid present in right side 112 of diaphragm chamber 106 is pushed through line 195 and check valve 201 to fluid discharge line 102. Check valve 203 in line 199 prevents fluid flow from right side 112 back into line 199 during rightward movement of diaphragm 110. At the same time, fluid is pulled from fluid suction line 105, line 197, check valve 205, and line 196 into left side 120 of diaphragm chamber 108 during rightward movement of diaphragm 118. Check valve 200 prevents fluid in line 193 from being pulled back into left side 120 during rightward movement of diaphragm 118.

Figure 23:
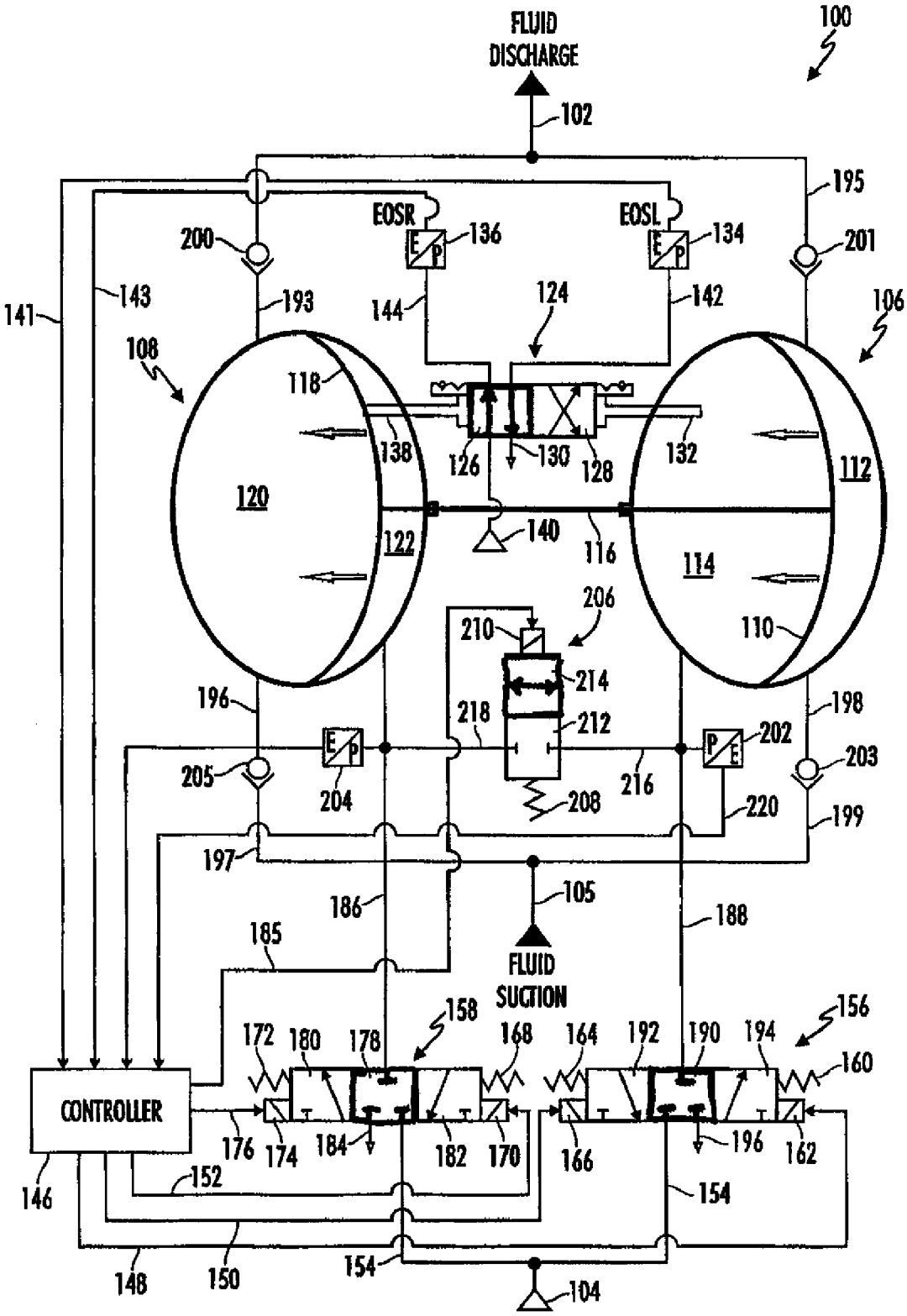
FIG. 23 is a schematic illustrating the AOD pump shown in FIG. 20.

In step 402, solenoids 170 and 162 remain energized for a user defined time period X milliseconds (mS). In step 404 the valves are placed in the Air-Saver 2 condition in which only solenoid 170 is energized (not shown in FIG. 22) and all other solenoids are deactivated as shown in table 382. In step 404, air in left side 114 of diaphragm chamber 106 expands to force diaphragms 118 and 110 rightward as shown in FIG. 22. In step 406 a timer in controller 146 is activated and the method proceeds to step 408. In step 408, if an end-of-stroke right signal, such as the condition shown in FIG. 23, is received by controller 146 from sensor 136 the method proceeds to step 412. If an end-of-stroke right signal is not received by controller 146 the method advances to step 410.

In step 410, a user selectable timeout period is compared to the time elapsed as measured by the timer started in step 406. If the elapsed time period has reached the timeout period the method returns to step 400. If the timeout period has not expired the method returns to step 408. As discussed above, when an end-of-stroke right signal is received by controller 146 in step 408 the method advances to step 412. In step 412, the air pressure in right side 122 of diaphragm chamber 108 is equalized with the air pressure in left side 114 of diaphragm chamber 106. As shown in FIG. 23. solenoid 210 of valve 206 is energized to allow air in left side 114 to flow through lines 188 and 216, valve 206, and lines 218 and 186 to right side 122 of diaphragm chamber 108. In step 414, the air pressure P1 of right side 122 is measured by sensor 204 and monitored by controller 146. The air pressure P2 of left side 114 is measured by sensor 202 which sends a corresponding signal to controller 146. Controller 146 then compares the difference between P2 and P1 with a predetermined user defined air pressure X. If the difference between P2 and P1 is less than or equal to X the method returns to step 384. If the difference between P2 and P1 is greater than X the method returns to step 412.

It should be understood that one having ordinary skill in the art would recognize that the methods of operating AOD pump 100 described above could be implemented in conventional AOD pumps to reduce compressed air consumption and operating efficiency.

Figure 24:
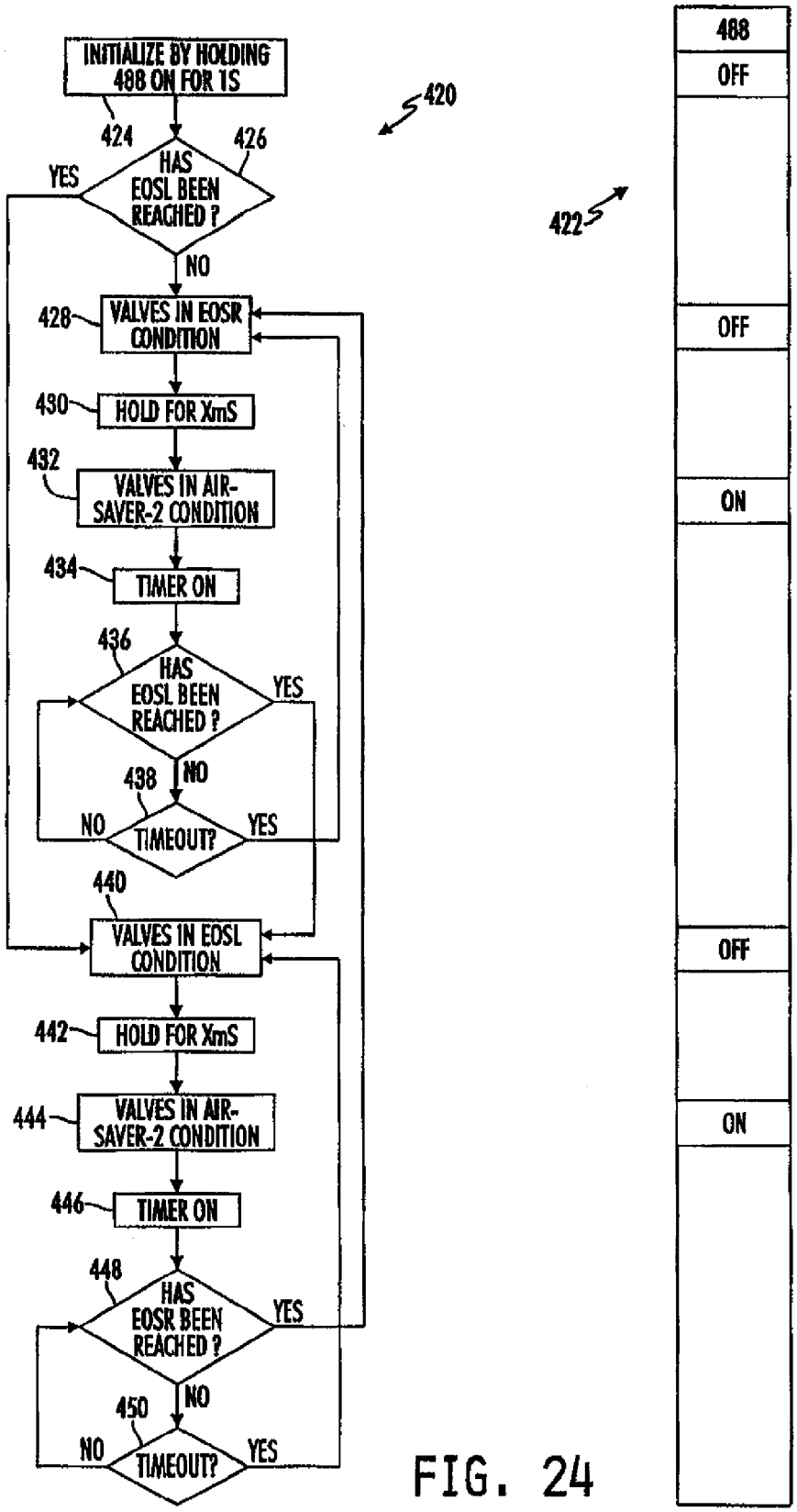
FIG. 24 is a flowchart and a logic table describing a method of operating the AOD pump shown in FIGS. 25-28.
Figure 25:
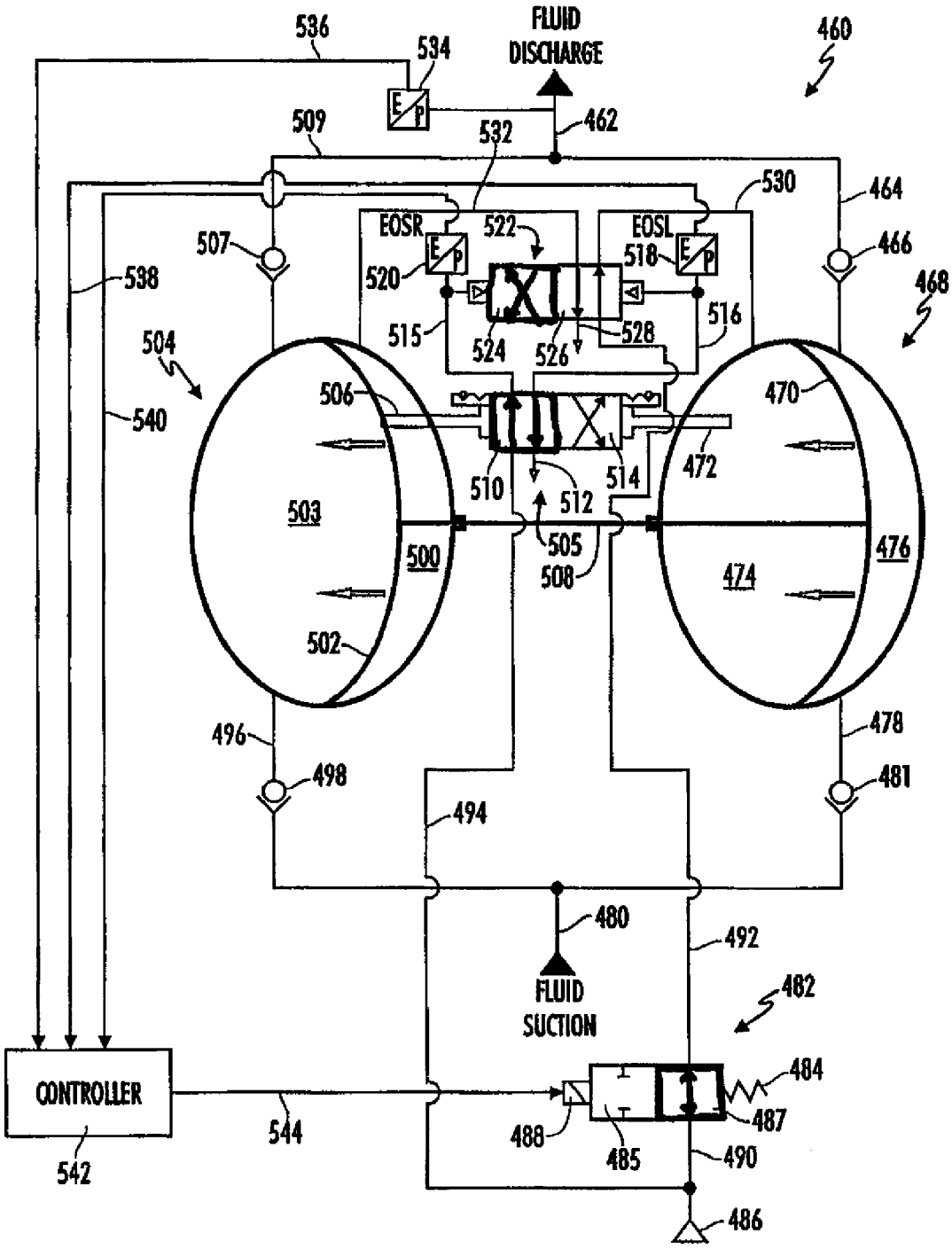
FIG. 25 is a schematic illustrating another embodiment of a AOD pump.

Another method and apparatus of the present invention is shown in FIGS. 24-28. As shown in FIG. 25, AOD pump 460 includes diaphragm chambers 468 and 504, pilot valve 505, directional valve 522, controller 542, control valve 482, and pressure sensors 534, 520, and 518. AOD pump 460 receives fluid at fluid suction line 480 and outputs pressurized fluid at fluid discharge line 462. Diaphragm chamber 504 includes left side 503, right side 500, and diaphragm 502. Diaphragm chamber 468 includes diaphragm 470, left side 474, and right side 476. Diaphragms 502 and 470 are coupled together by rod 508.

In this embodiment, pilot valve 505 is a four-port, two position valve. Pilot valve 505 includes control rods 506 and 472 and porting configurations 510 and 514. Porting configuration 510 connects line 494 with line 515 and line 516 with exhaust port 512. Porting configuration 514 connects line 494 with line 516 and line 515 with exhaust port 512. Directional valve 522 is also a four-port, two position valve and includes porting configurations 524 and 526. Porting configuration 524 connects line 530 with exhaust port 528 and line 492 with line 532. Porting configuration 526 connects line 532 with exhaust port 528 and line 492 with line 530. Pilot valve 505 and directional valve 522 are substantially similar to pilot valve 26 and directional valve 50 shown in FIG. 1.

Control valve 482 is a two-port, two position normally open solenoid valve with spring return. Control valve 482 includes porting configurations 487 and 485. Spring 484 positions porting configuration 487 in the active position of valve 482. Porting configuration 487 connects line 490 with line 492. Porting configuration 485 closes lines 490 and 492. Solenoid 488 can be energized to overcome the force exerted by spring 484 and move porting configuration 485 into the active position in valve 482.

Controller 542 receive electrical signals from pressure sensors 534, 520, and 518 through lines 536, 540, and 538, respectively. Pressure sensor 534 senses the pressure in line 462. Pressure sensor 520 senses an end-of-stroke right condition by sensing the air pressure in line 515 and sends a corresponding signal to controller 542. Pressure sensor 518 senses an end-of-stroke left condition by sensing the air pressure in line 516 and sends a corresponding signal to controller 542. Controller 542 controls solenoid 488 using line 544.

A method of operating AOD pump 460 is shown in FIG. 24. FIG. 24 includes a flowchart 420 and a corresponding table 422 illustrating the status of the solenoid 488 during the steps of the method. In FIG. 25, diaphragms 502 and 470 have just reached the end-of-stroke right condition. Porting configuration 510 is locked into the active position in pilot valve 505. Compressed air from line 494 is supplied to line 515 which moves and locks porting configuration 524 into the active position in directional valve 522. Air in line 516 is exhausted to the atmosphere through exhaust port 512. Pressure sensor 520 senses the air pressure increase in line 515 and sends an end-of-stroke right signal to controller 542. When porting configuration 524 is in the active position in valve 522, air from left side 474 of diaphragm chamber 468 is vented to the atmosphere through exhaust port 528 and compressed air from line 492 is supplied to right side 500 of diaphragm chamber 504 through valve 522.

In step 424, the method of operating AOD pump 460 is initialized by maintaining solenoid 488 in a deactivated state for a user selectable time period, for example, 1 second, to start pump 460. During the user selectable time period, the pump operates without the airsaver feature in mechanical mode as described in FIG. 1. After the user selectable time period, 1 second in this example, expires the method advances to step 426. In step 426, if the end-of-stroke left signal is received by controller 542, the method advances to 440, which is described below. If an end-of-stroke left signal is not received, the method advances to step 428.

Figure 26:
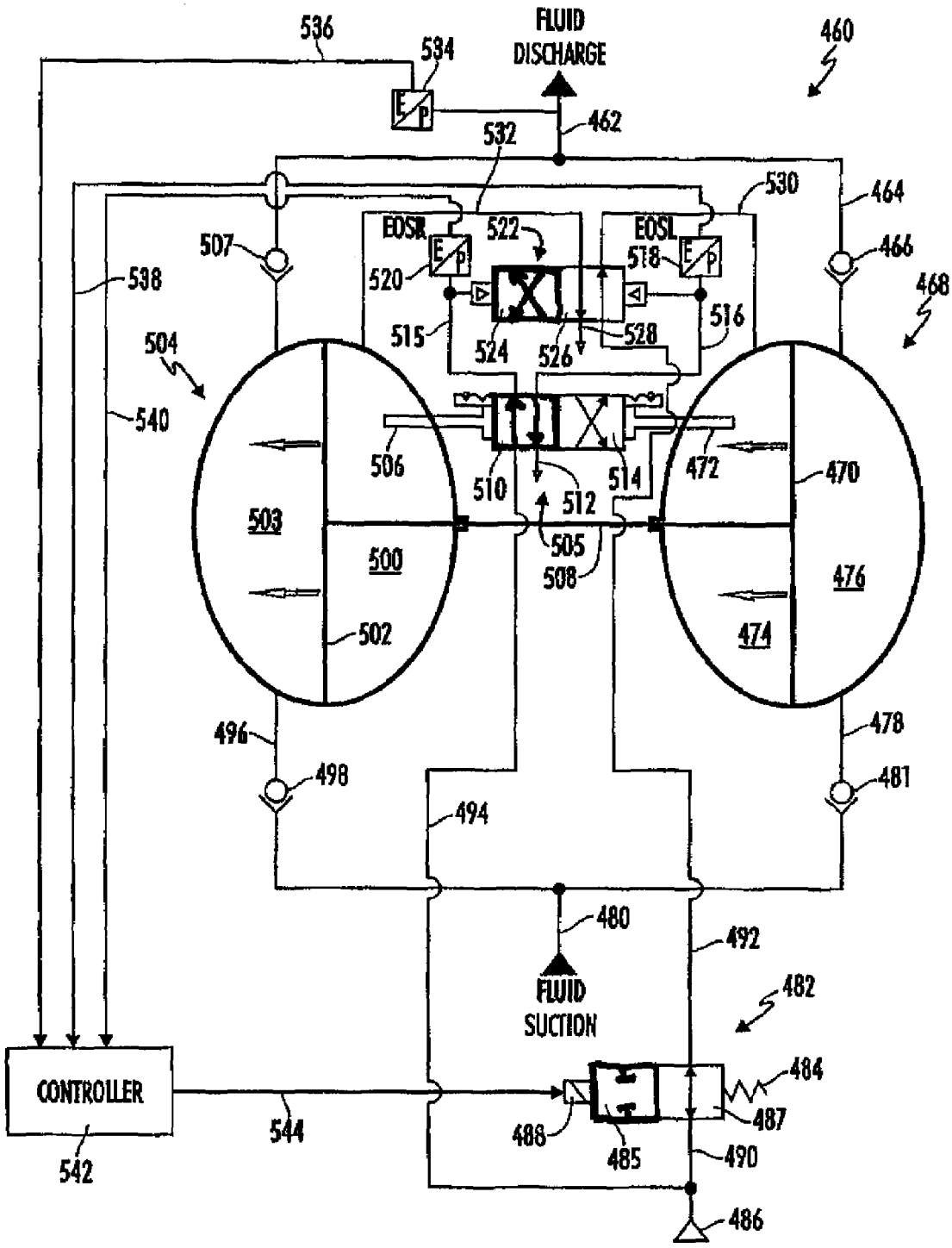
FIG. 26 is a schematic illustrating the AOD pump shown in FIG. 25.

In step 428, valves 505 and 522 are still locked in the end-of-stroke right configuration and solenoid 488 remains deactivated and the method advances to step 430. In step 430, solenoid 488 remains de-energized for a user selectable time period X milliseconds (mS) allowing spring 484 to hold porting configuration 487 in the active position of valve 482. In step 432, which places the valves in the Air Saver 2 condition, solenoid 488 is energized to move porting configuration 485 into the active position in valve 482 as shown in FIG. 26. Porting configuration 485 closes lines 490 and 492. The Air Saver 2 condition allows air previously pushed into right side 500 diaphragm chamber 504 to expand and air to exhaust from left side 474 of chamber 468 to move diaphragms 502 and 470 leftward. In step 434, controller 542 activates a timer and the method advances to step 436.

In step 436, if end-of-stroke left is reached, the method advances to step 440. If end-of-stroke left is not reached, the method advances to step 438. In step 438, a user selectable timeout period is compared to the time elapsed as measured by the timer started in step 434. If the elapsed time period has reached the timeout period the method returns to step 428. If the timeout period has not expired the method returns to step 436. As discussed above, when an end-of-stroke left signal is received by controller 542 in step 436 the method advances to step 440.

Figure 27:
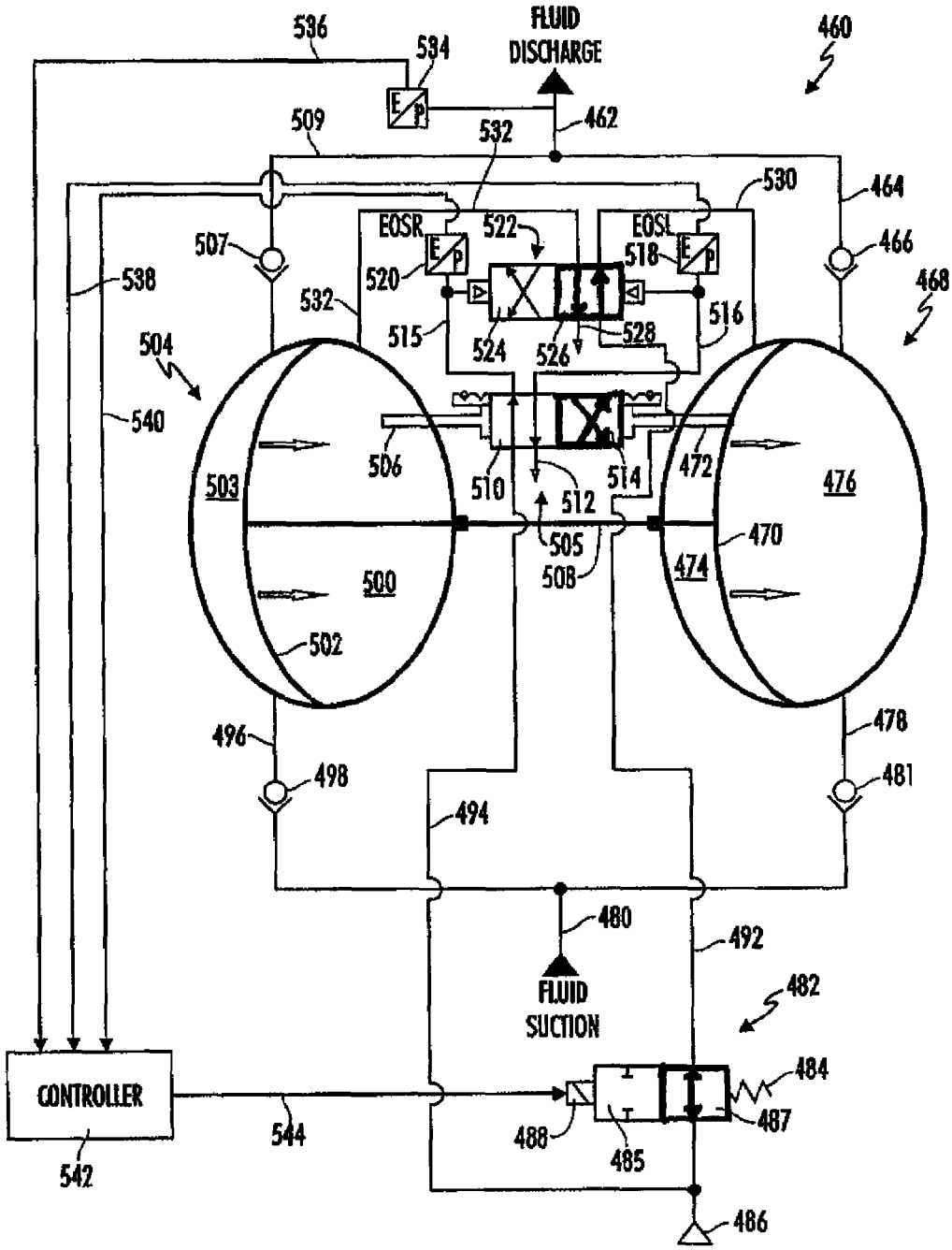
FIG. 27 is a schematic illustrating the AOD pump shown in FIG. 25.

In step 440, valves 505 and 522 are locked in the end-of-stroke left condition and solenoid 488 is de-energized to place porting configuration 487 in the active position in valve 482. As shown in FIG. 27, compressed air is being supplied to left side 474 of diaphragm chamber 468 and air in right side 500 of diaphragm chamber 504 is being exhausted through exhaust port 528. Fluid present in right side 476 of diaphragm chamber 468 is pushed through line 464 and check valve 466 to fluid discharge line 462. Check valve 481 in line 478 prevents fluid from flowing from right side 476 back into line 478 during rightward movement of diaphragm 470. At the same time, fluid is pulled from fluid suction line 480, line 496, and check valve 498 into left side 503 of diaphragm chamber 504 during rightward movement of diaphragm 502. Check valve 507 prevents fluid in line 509 from being pulled back into left side 503 during rightward movement of diaphragm 502.

Figure 28:
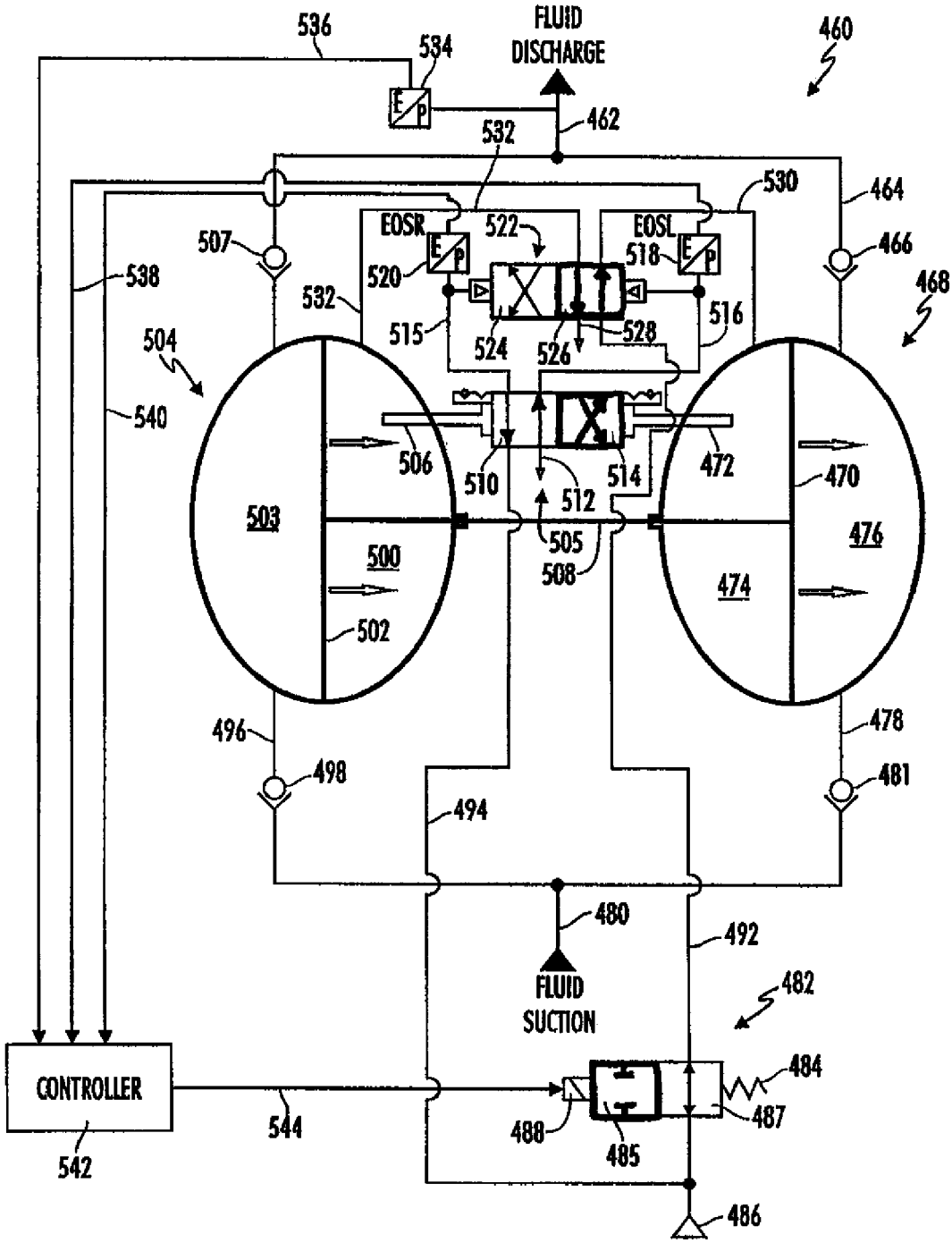
FIG. 28 is a schematic illustrating the AOD pump shown in FIG. 25.

In step 442, solenoid 488 remains de-energized for a user defined time period X milliseconds (mS), allowing spring 484 to hold porting configuration 487 in the active position of valve 482 as shown in FIG. 28. In step 444 solenoid 488 is energized and moves porting configuration 485 into the active position in valve 482. Porting configuration 485 closes lines 490 and 492 which places valve 482 into the airsaver 2 condition. Air previously pushed into left side 474 of diaphragm chamber 468 expands and air exhausts from right side 500 of diaphragm chamber 504 to force diaphragms 470 and 502 rightward. In step 446 a timer in controller 542 is activated and the method proceeds to step 448. In step 448, if an end-of-stroke right signal is received by controller 542 from sensor 520 the method proceeds to step 428. If an end-of-stroke right signal is not received by controller 542 the method advances to step 450.

In step 450, a user selectable timeout period is compared to the time elapsed as measured by the timer started in step 446. If the elapsed time period has reached the timeout period the method returns to step 440. If the timeout period has not expired the method returns to step 448.

In the embodiment described above, a power failure to controller 542 or solenoid 488 allows the pump to continue to operate assuming compressed air is continuously supplied by air supply 486.

Figure 29:
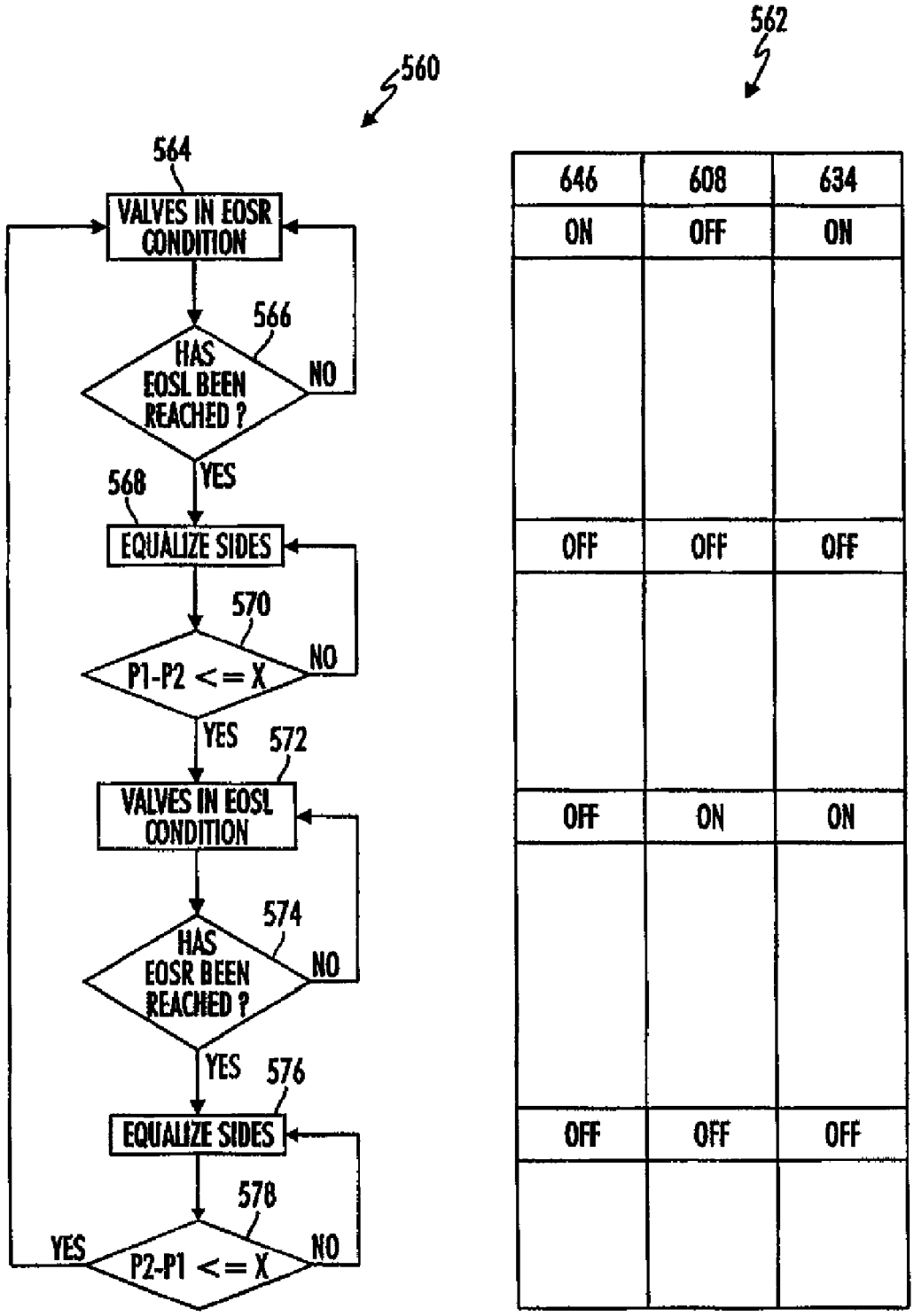
FIG. 29 is a flowchart and a logic table describing a method of operating the AOD pump shown in FIGS. 30-32.
Figure 30:
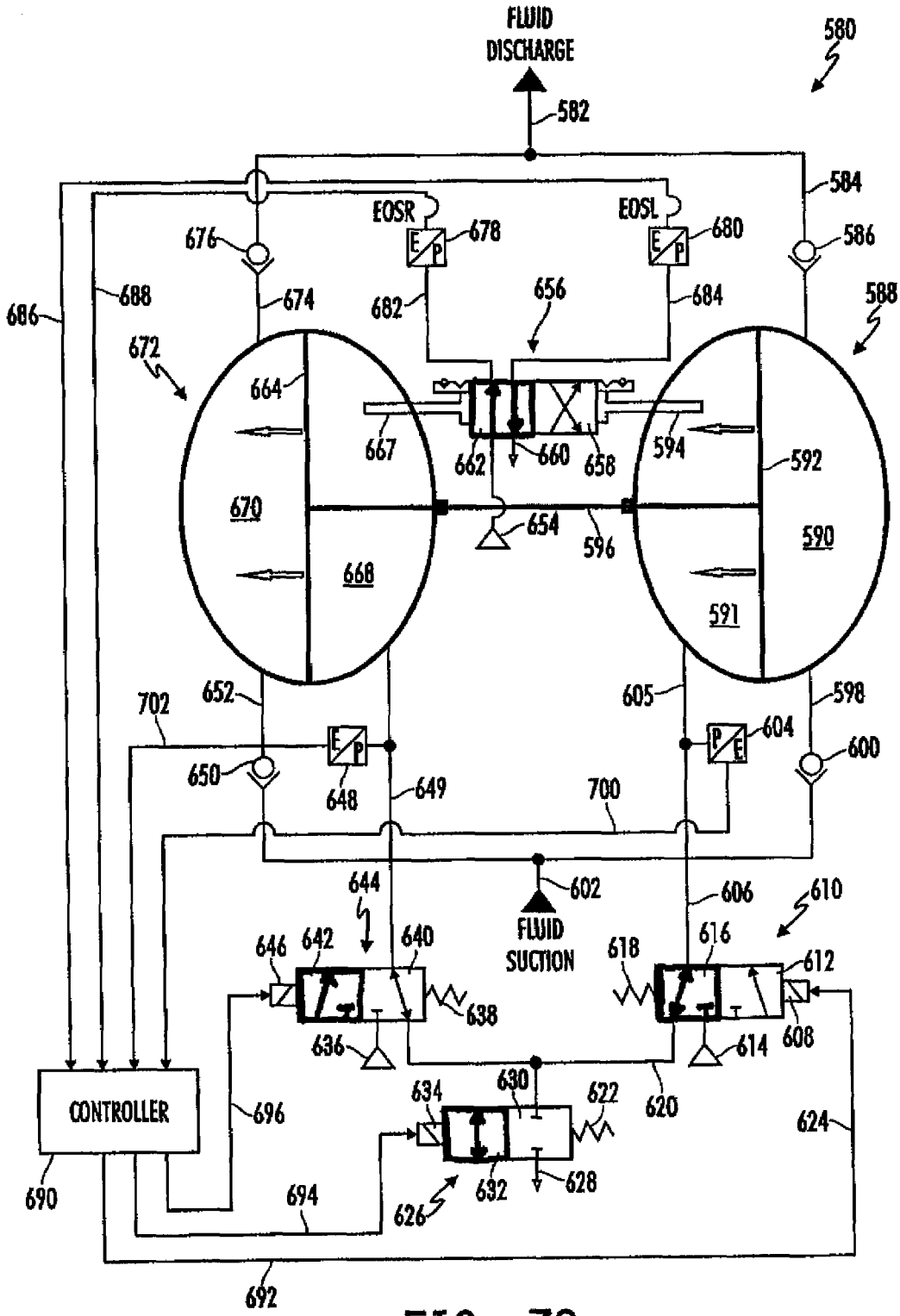
FIG. 30 is a schematic illustrating another embodiment of a AOD pump.

Another method and apparatus of the present invention is shown in FIGS. 29-32. An AOD pump 580 including diaphragm chambers 588 and 672, pilot valve 656, controller 670, and control valves 644, 626, and 610 is shown in FIG. 30. AOD pump 580 receives fluid at fluid suction line 602 and outputs pressurized fluid at fluid discharge 582. Diaphragm chamber 588 includes left side 591, right side 590, and diaphragm 592. Diaphragm chamber 672 includes left side 670, right side 668, and diaphragm 664. Diaphragms 664 and 592 are coupled together by rod 596.

Pilot valve 656 functions similarly to pilot valve 26 shown in FIG. 1. Pilot valve 656 is a four-port, two position valve. Pilot valve 656 includes control rods 667 and 594 and porting configurations 662 and 658. Porting configuration 662 connects air supply 654 to line 682 and line 684 to exhaust port 660. Porting configuration 658 connects air supply 654 to line 684 and line 682 to exhaust port 660. Pressure sensor 678 is coupled to line 682 and sends an electrical signal to controller 670 indicating an end-of-stroke right condition has been detected when air is supplied to line 682. Similarly, pressure sensor 680 is coupled to line 684 and sends an electrical signal to controller 670 indicating an end-of-stroke left condition has been detected when air is supplied to line 684.

Control valves 644 and 610 are three-port, two position solenoid valves with spring return. Control valve 644 includes porting configurations 640 and 642. Spring 638 maintains porting configuration 640 in the active position in valve 644 when solenoid 646 is de-energized. Solenoid 646 can be energized to move porting configuration 642 into the active position of valve 644. Porting configuration 640 connects line 620 with 649 and closes air supply 636. Porting configuration 642 connects line 649 with air supply 636 and closes line 620. Control valve 610 includes porting configurations 612 and 616. Spring 618 maintains porting configuration 616 in the active position in valve 610 when solenoid 608 is de-energized. Solenoid 608 can be energized to move porting configuration 612 into the active position of valve 610. Porting configuration 616 connects line 620 with 606 and closes air supply 614. Porting configuration 612 connects line 606 with air supply 614 and closes line 620.

Control valve 626 is a two-port, two position solenoid valve with spring return. Control valve 626 includes porting configurations 630 and 632. Spring 622 maintains porting configuration 630 in the active position in valve 626 when solenoid 634 is de-energized. Solenoid 634 can be energized to move porting configuration 632 into the active position of valve 626. Porting configuration 632 connects line 620 with exhaust port 628. Porting configuration 630 closes line 620 and exhaust port 628.

Referring now to flowchart 560 and table 562 in FIG. 29, a method of operating AOD pump 580 is shown. In step 564, the pilot valve 656 is locked in the end-of-stroke right condition and solenoids 646 and 634 are energized as shown in FIG. 30. Solenoid 646 moves porting configuration 642 into the active position in valve 644 which allows compressed air from air supply 636 to flow to right side 668 of diaphragm chamber 672 through line 649. Solenoid 634 moves porting configuration 632 into the active position in valve 626. Spring 618 of valve 610 holds porting configuration 616 in the active position to allow air from left side 591 of diaphragm chamber 588 to be vented to the atmosphere through lines 605,620, and exhaust port 628.

Figure 31:
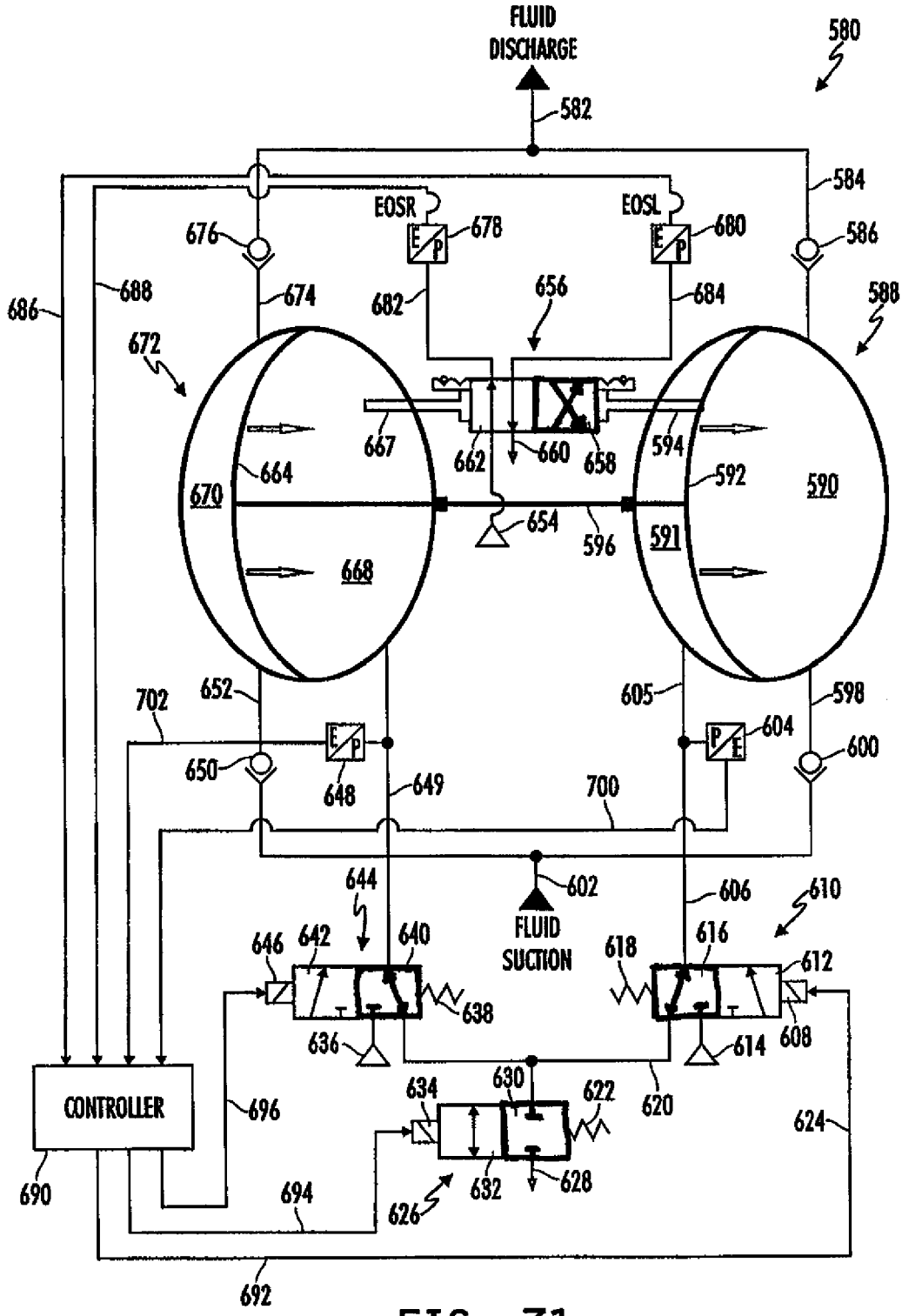
FIG. 31 is a schematic illustrating the AOD pump shown in FIG. 30.

In step 566, if diaphragms 664 and 592 reach end-of-stroke left, as shown in FIG. 31, the method advances to step 568. If diaphragms 664 and 592 have not reached end-of-stroke left the method returns to step 564. In step 568, the pressure in right side 668 of diaphragm chamber 672 is equalized with the pressure in left side 591 of diaphragm chamber 588. All solenoids are deactivated so that air in right side 668 can flow through line 649, valve 644, line 620, valve 616 and line 605 to left side 591 of diaphragm chamber 588. In step 568, porting configuration 640 is in the active position in valve 644, porting configuration 616 is in the active position in valve 610, and porting configuration 630 is in the active position in valve 626.

Sensor 648 measures the pressure P1 in right side 668 and sends a corresponding signal to controller 670. Sensor 604 measures the pressure P2 in left side 591 and sends a corresponding signal to controller 670. Controller 670 compares the difference between P1 and P2 to a user selectable pressure X. If the difference between P1 and P2 is less than or equal to X the method advances to step 572. If the difference between P1 and P2 is greater than X the method returns to step 568.

Figure 32:
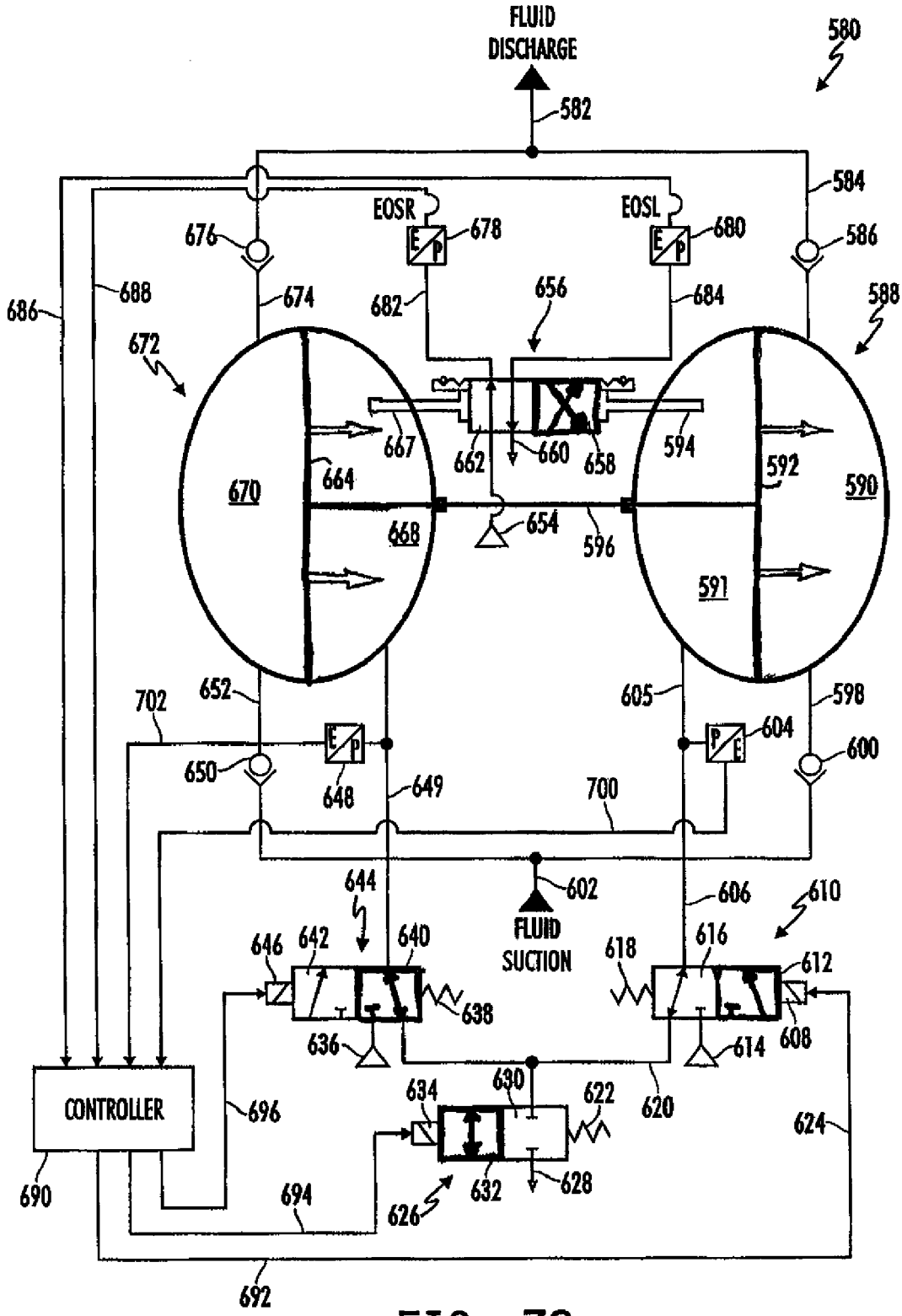
FIG. 32 is a schematic illustrating the AOD pump shown in FIG. 30.

In step 572, the pilot valve 656 is locked in the end-of-stroke left condition and solenoids 608 and 634 are energized as shown in FIG. 32. Solenoid 608 moves porting configuration 612 into the active position in valve 610 which allows compressed air from air supply 614 to flow to left side 591 of diaphragm chamber 588. Solenoid 634 moves porting configuration 632 into the active position in valve 626 to allow air from right side 668 of diaphragm chamber 672 to be vented to the atmosphere through exhaust port 628.

In step 574, if diaphragms 664 and 592 reach end-of-stroke right, the method advances to step 576. If diaphragms 664 and 592 have not reached end-of-stroke right the method returns to step 572. In step 576, the pressure in right side 668 of diaphragm chamber 672 is equalized with the pressure in left side 591 of diaphragm chamber 588. All solenoids are deactivated so that air in left side 591 can flow through line 605, valve 610, line 620, valve 644 and line 649 to right side 668 of diaphragm chamber 672. In step 576, porting configuration 640 is in the active position in valve 644, porting configuration 616 is in the active position in valve 610, and porting configuration 630 is in the active position in valve 626.

In step 578, controller 670 compares the difference between P2 and P1 to the user selectable pressure X. If the difference between P2 and P1 is less than or equal to X the method returns to step 564. If the difference between P2 and P1 is greater than X the method returns to step 576.

Figure 33:
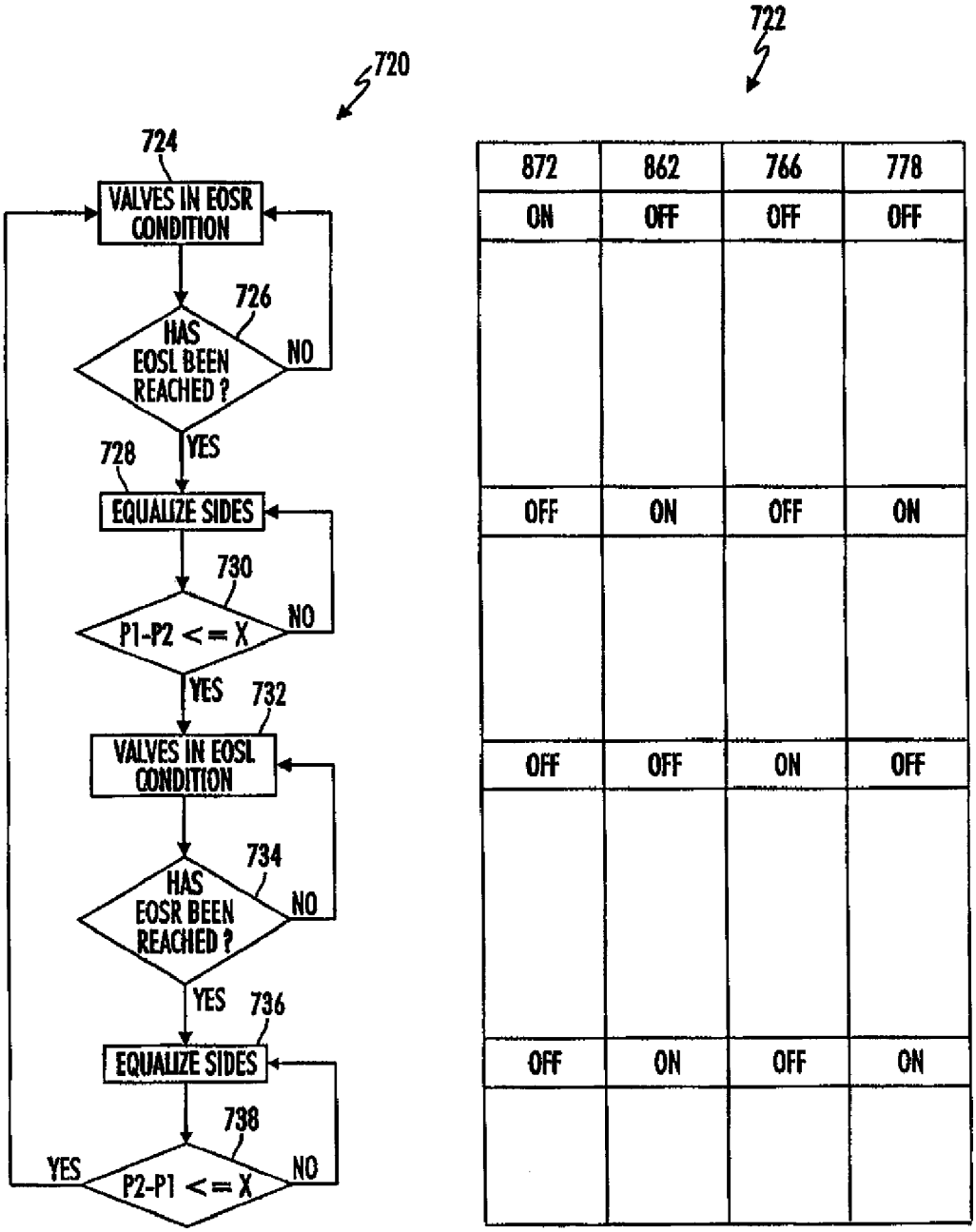
FIG. 33 is a flowchart and a logic table describing a method of operating the AOD pump shown in FIGS. 34-37.
Figure 34:
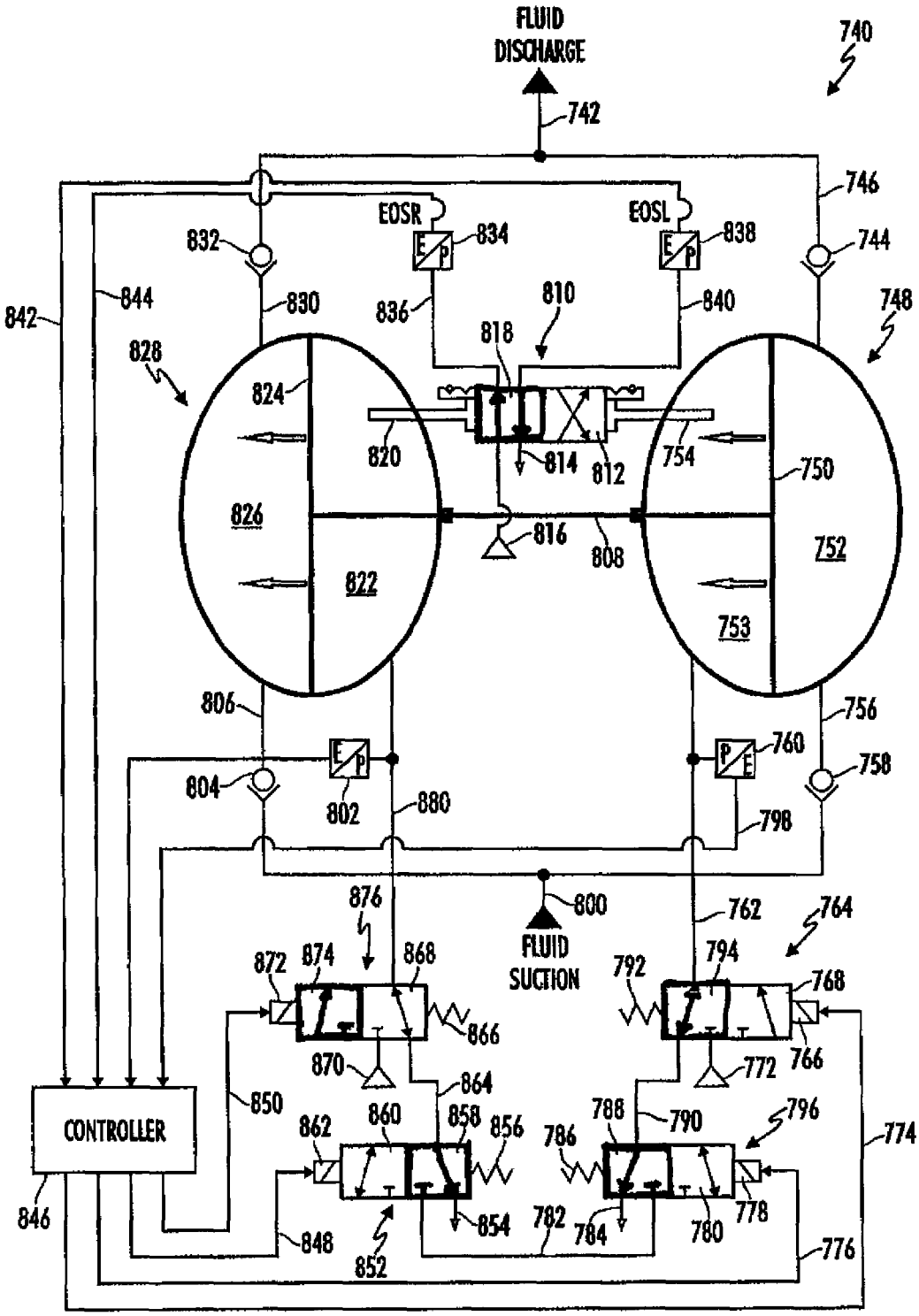
FIG. 34 is a schematic illustrating another embodiment of a AOD pump.

Another method and apparatus of the present invention is shown in FIGS. 33-37. An AOD pump 740 including diaphragm chambers 748 and 828, pilot valve 810, controller 846, and control valves 876, 852, 796, and 764 is shown in FIG. 34. AOD pump 740 receives fluid at fluid suction line 800 and outputs pressurized fluid at fluid discharge line 742. Diaphragm chamber 828 includes left side 826, right side 822, and diaphragm 824. Diaphragm chamber 748 includes left side 753, right side 752, and diaphragm 750. Diaphragms 824 and 750 are coupled together by rod 808.

Pilot valve 810 functions similarly to pilot valve 26 shown in FIG. 1. Pilot valve 810 is a four-port, two position valve. Pilot valve 810 includes control rods 820 and 754 and porting configurations 812 and 818. Porting configuration 818 connects air supply 816 to line 836 and line 840 to exhaust port 814. Porting configuration 812 connects air supply 816 to line 840 and line 836 to exhaust port 814. Pressure sensor 834 is coupled to line 836 and sends an electrical signal to controller 846 indicating an end-of-stroke right condition has been detected when air is supplied to line 836. Similarly, pressure sensor 838 is coupled to line 840 and sends an electrical signal to controller 846 indicating an end-of-stroke left condition has been detected when air is supplied to line 840.

Control valves 876, 852, 796, and 764 are three-port, two position solenoid valves with spring return. Control valve 876 includes porting configurations 874 and 868. Spring 866 maintains porting configuration 868 in the active position in valve 876 when solenoid 872 is de-energized. Solenoid 872 can be energized to move porting configuration 874 into the active position of valve 876. Porting configuration 868 connects line 880 with line 864 and closes air supply 870. Porting configuration 874 connects line 880 with air supply 870 and closes line 864. Control valve 852 includes porting configurations 860 and 858. Spring 856 maintains porting configuration 858 in the active position in valve 852 when solenoid 862 is de-energized. Solenoid 862 can be energized to move porting configuration 860 into the active position of valve 852. Porting configuration 858 connects line 864 with exhaust port 854 and closes line 782. Porting configuration 860 connects line 864 with line 782 and closes exhaust port 854.

Control valve 764 includes porting configurations 794 and 768. Spring 792 maintains porting configuration 794 in the active position in valve 764 when solenoid 766 is de-energized. Solenoid 766 can be energized to move porting configuration 768 into the active position of valve 764. Porting configuration 794 connects line 762 with line 790 and closes air supply 772. Porting configuration 768 connects line 762 with air supply 772 and closes line 790. Control valve 796 includes porting configurations 780 and 788. Spring 786 maintains porting configuration 788 in the active position in valve 796 when solenoid 778 is de-energized. Solenoid 778 can be energized to move porting configuration 780 into the active position of valve 796. Porting configuration 788 connects line 790 with exhaust port 784 and closes line 782. Porting configuration 780 connects line 782 with line 790 and closes exhaust port 784.

As shown in FIG. 34, diaphragms 824 and 750 have recently been in the end-of-stroke right position and are moving leftward. In this condition, fluid present in left side 826 of diaphragm chamber 828 is pushed through line 830 and check valve 832 to fluid discharge line 742. Check valve 804 in line 806 prevents fluid from flowing back into line 806 from left side 826 during leftward movement of diaphragm 824. At the same time, diaphragm 750 is moving leftward which creates a vacuum in right side 752 of diaphragm chamber 748. Fluid is pulled from line 800 through check valve 758 and line 756 into right side 752. Check valve 744 in line 746 prevents fluid in line 746 from being pulled back into right side 752 during leftward movement of diaphragm 750.

Figure 35:
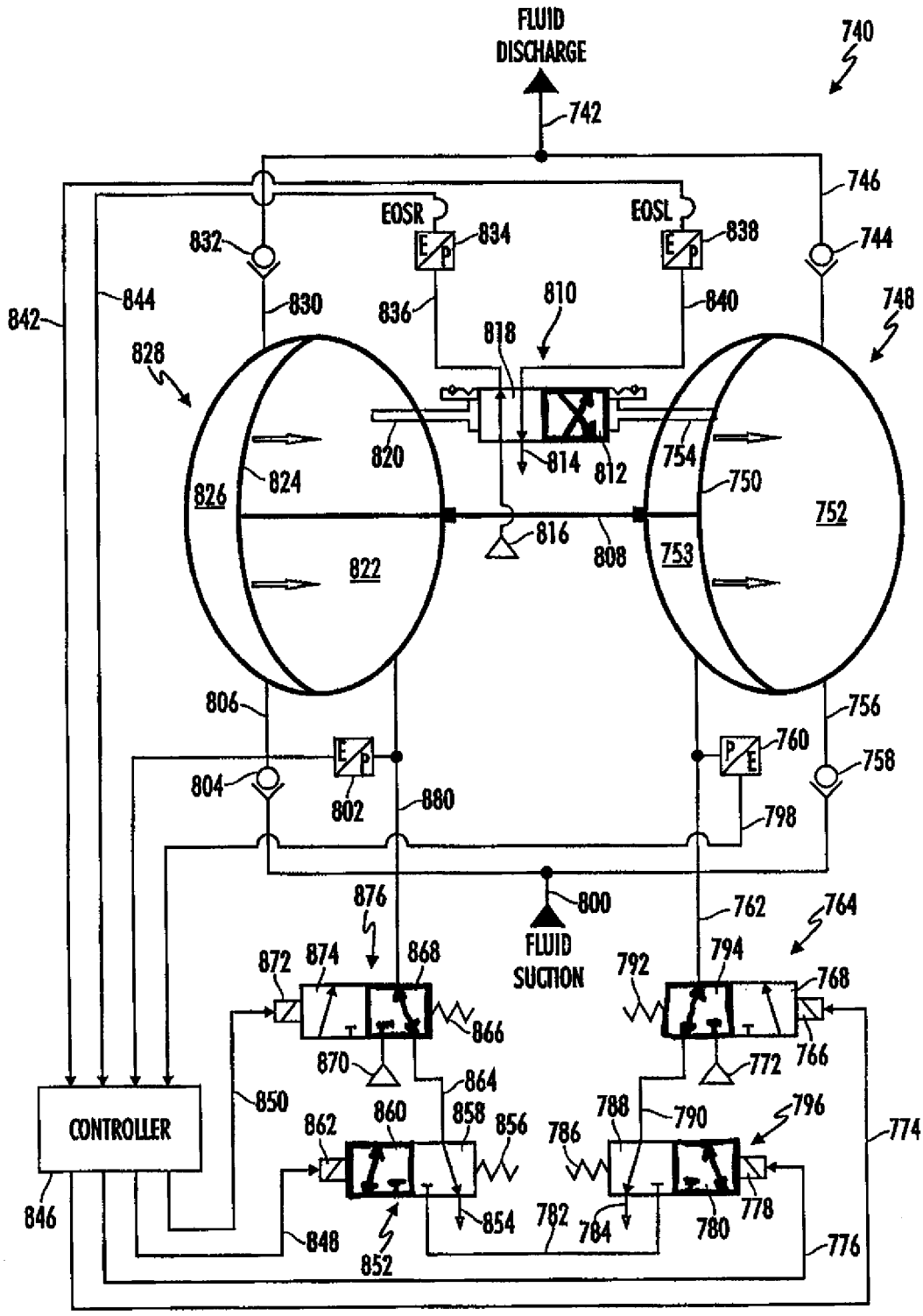
FIG. 35 is a schematic illustrating the AOD pump shown in FIG. 34.

Referring now to FIG. 35, diaphragms 824 and 750 have reached the end-of-stroke left position and are beginning to move rightward. In this condition, fluid present in right side 752 of diaphragm chamber 748 is pushed through line 746 and check valve 744 to fluid discharge line 742. Check valve 758 in line 756 prevents fluid from flowing back into line 756 from right side 752 during rightward movement of diaphragm 750. At the same time, diaphragm 824 is moving rightward which creates a vacuum in left side 826 of diaphragm chamber 828. Fluid is pulled from line 800 through check valve 804 and line 806 into left side 826. Check valve 832 in line 830 prevents fluid in line 830 from being pulled back into left side 826 during rightward movement of diaphragm 824.

Referring now to flowchart 720 and table 722 on FIG. 33, a method of operating AOD pump 740 shown. In step 724, pilot valve 810 is locked in the end-of-stroke right condition and solenoid 872 is energized. Solenoid 872 moves porting configuration 874 into the active position in valve 876 which allows compressed air from air supply 870 to flow to right side 822 of diaphragm chamber 828 to move diaphragm 824 leftward as shown in FIG. 34. In valve 764, porting configuration 794 is in the active position which allows air in left side 753 to pass through line 762 to line 790. In valve 796, porting configuration 788 is in the active position to allow air in line 790 to be vented to the atmosphere through exhaust port 784 as diaphragm 750 moves leftward.

Figure 36:
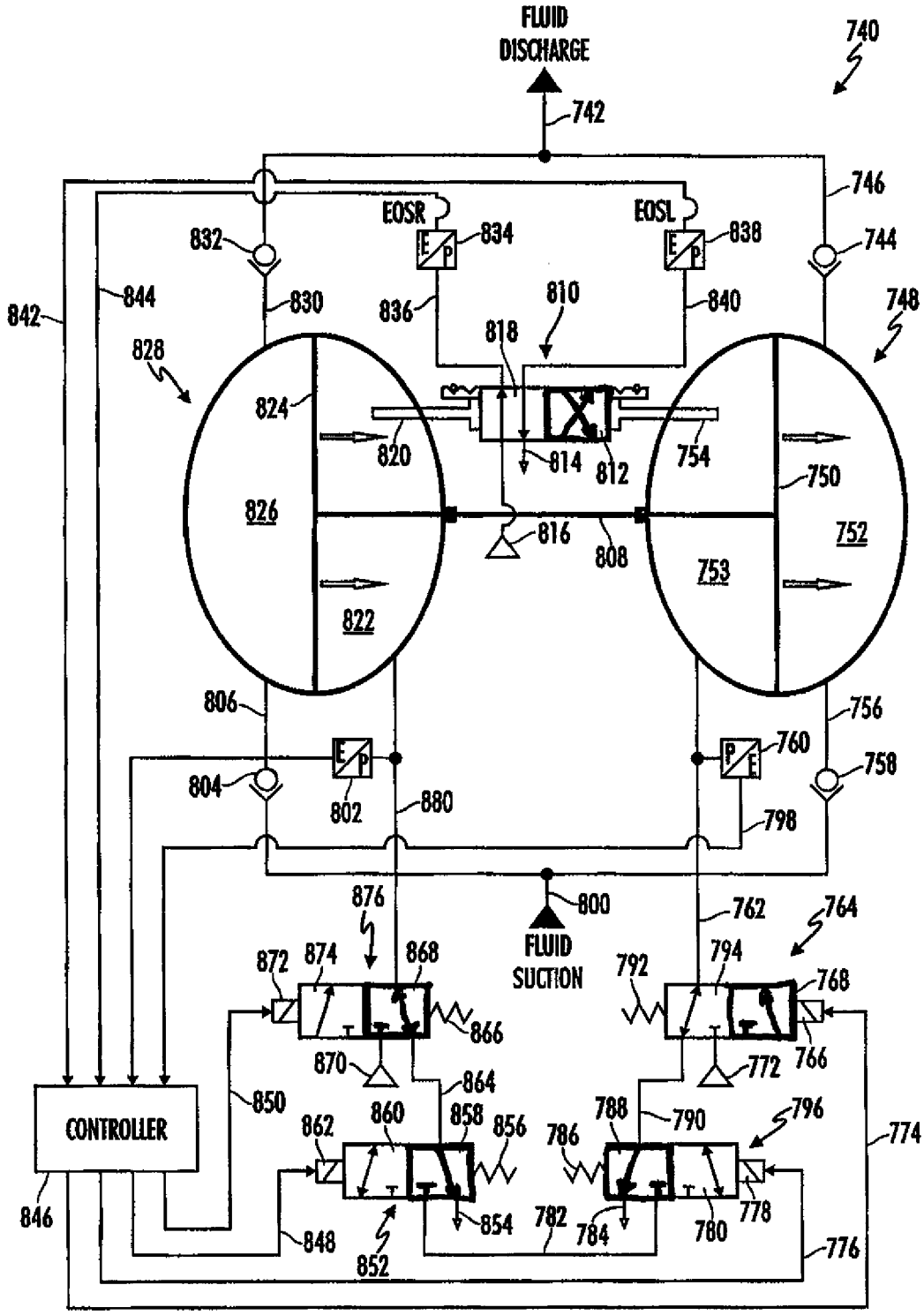
FIG. 36 is a schematic illustrating the AOD pump shown in FIG. 34.

In step 726, if diaphragms 824 and 750 reach end-of-stroke left, as shown in FIG. 35, the method advances to step 728. If diaphragms 824 and 750 have not reached end-of-stroke left the method returns to step 724. In step 728, the pressure in right side 822 of diaphragm chamber 828 is equalized with the pressure in left side 753 of diaphragm chamber 748 to move diaphragms 824 and 750 rightward as shown in FIG. 36. Solenoids 862 and 778 are energized to move porting configurations 860 and 780 into the active positions of valves 852 and 796. In step 728, air in right side 822 flows through line 880, valve 876, line 864, valve 852, line 782, valve 796, line 790, valve 764, and line 762 to left side 753 of diaphragm chamber 748. In step 728, porting configuration 868 is in the active position in valve 876 and porting configuration 794 is in the active position in valve 764.

Sensor 802 measures the pressure P1 in right side 822 and sends a corresponding signal to controller 846. Sensor 760 measures the pressure P2 in left side 753 and sends a corresponding signal to controller 846. Controller 846 compares the difference between P1 and P2 to a user selectable pressure X. If the difference between P1 and P2 is less than or equal to X the method advances to step 732. If the difference between P1 and P2 is greater than X the method returns to step 728.

In step 732, pilot valve 810 is locked in the end-of-stroke left condition and solenoid 766 is energized. Solenoid 766 moves porting configuration 768 into the active position in valve 764 which allows compressed air from air supply 772 to flow to left side 753 of diaphragm chamber 748. Porting configuration 868 is in the active position in valve 876 to allow air from right side 822 of diaphragm chamber 828 through line 880 and valve 876 to line 864. Porting configuration 858 is in the active position in valve 852 to allow air in line 864 to be vented to the atmosphere through exhaust port 854.

Figure 37:
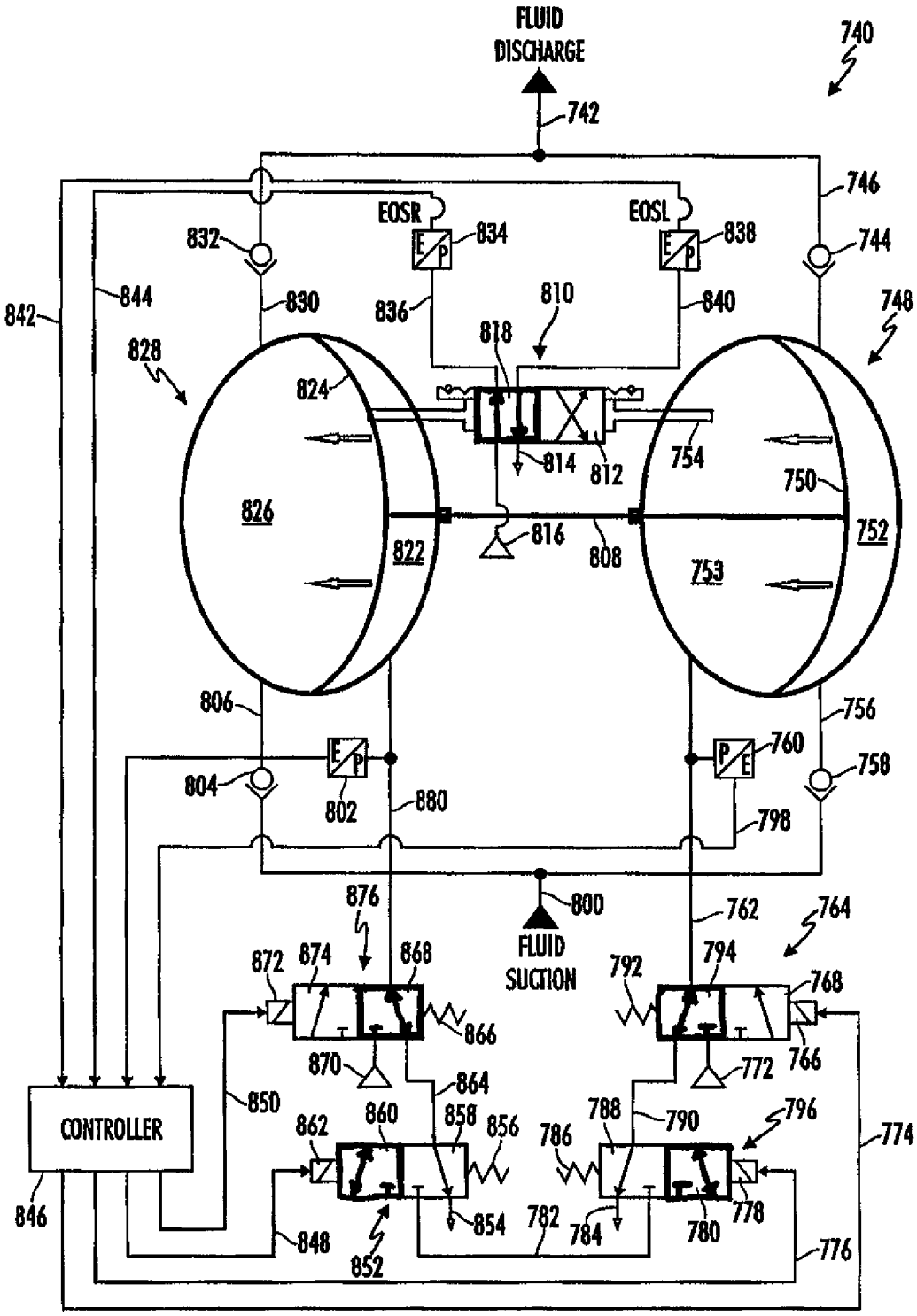
FIG. 37 is a schematic illustrating the AOD pump shown in FIG. 34.

In step 734, if diaphragms 824 and 750 reach end-of-stroke right, as shown in FIG. 37, the method advances to step 736. If diaphragms 824 and 750 have not reached end-of-stroke right the method returns to step 732. In step 736, the pressure in right side 822 of diaphragm chamber 828 is equalized with the pressure in left side 753 of diaphragm chamber 748. As shown in table 722 on FIG. 33, solenoids 862 and 778 are energized to allow air in left side 753 to flow through line 762, valve 764, line 790, valve 796, line 782, valve 852, line 864, valve 876, and line 880 to right side 822 of diaphragm chamber 828. In step 736, porting configuration 868 is in the active position in valve 876 and porting configuration 794 is in the active position in valve 764.

In step 738, controller 846 compares the difference between P2 and P1 to the user selectable pressure X. If the difference between P2 and P1 is less than or equal to X the method returns to step 724. If the difference between P2 and P1 is greater than X the method returns to step 736.

Although the invention has been described in detail with reference to certain preferred embodiments, variations and modifications exist within the spirit and scope of the invention as described and defined in the following claims.

The invention claimed is:

1. An AOD pump including:

first and second diaphragm chambers, each diaphragm chamber including a diaphragm, the diaphragms coupled together;

first and second sensors configured to detect end-of-stroke right and end-of-stroke left positions of the diaphragms and to output signals indicative thereof;

a first valve moveable between first and second positions, the first position configured to supply air to the first diaphragm chamber, the second position configured to supply air to the second diaphragm chamber;

a second valve moveable between an open position and a closed position, the open position configured to connect an air supply to the first valve, the closed position configured to close the air supply; and a controller configured to receive signals from the first and second sensors and to selectively open and close the second valve for a first time period.

2. The AOD pump of claim 1, wherein the first time period is user selectable.

3. The AOD pump of claim 1, wherein the first valve is a directional valve.

4. The AOD pump of claim 1, wherein the second valve is a solenoid actuated valve with a spring return.

5. The AOD pump of claim 1, further comprising a third valve movable between first and second positions, the first position configured to move the first valve into the first position, the second position configured to move the first valve into the second position.

6. The AOD pump of claim 5, wherein the third valve moves in response to movement of the diaphragms.

7. A system for controlling an AOD pump including first and second diaphragm chambers, first and second diaphragms positioned in the diaphragm chambers, first and second sensors configured to detect end-of-stroke right and end-of-stroke left positions of the diaphragms and to output signals indicative thereof, the system including:

a first valve moveable between first and second positions, the first position configured to supply a gas to the first diaphragm chamber, the second position configured to supply the gas to the second diaphragm chamber;

a second valve moveable between an open position and a closed position, the open position configured to connect a gas supply to the first valve, the closed position configured to close the gas supply; and a controller configured to receive signals from the first and second sensors and to selectively open and close the second valve for a first time period.

8. An AOD pump including:

first and second diaphragm chambers, each diaphragm chamber including a diaphragm, the diaphragms coupled together;

a sensor configured to detect a position of a diaphragm and to output a signal indicative thereof;

a first valve moveable between first and second positions, the first position configured to supply a gas to the first diaphragm chamber, the second position configured to supply gas to the second diaphragm chamber;

a second valve moveable between an open position and a closed position, the open position configured to connect a gas supply to the first valve, the closed position configured to close the gas supply; and a controller configured to receive the signal from the sensor and to selectively open and close the second valve for a first time period.

9. A system for controlling an AOD pump having a first chamber with a first diaphragm and a second chamber with a second diaphragm coupled to the first diaphragm, the system including:

a valve assembly being movable into a plurality of positions for directing a gas into the chambers, exhausting gas from the chambers, and closing off the chambers; and a controller configured to cause the valve assembly to direct the gas into one of the chambers, to exhaust gas from the other of the chambers, and to close off the one chamber before the first and second diaphragms reach an end-of-stroke position to permit the gas to expand in the one chamber, thereby moving the diaphragms from a first position to a second position.

10. A system for controlling an AOD pump having a first chamber with a first diaphragm and a second chamber with a second diaphragm coupled to the first diaphragm, the system including:

a valve assembly configured to provide a gas to the chambers; and a controller configured to cause the valve assembly to provide the gas to one chamber at a first pressure and reduce the pressure before the diaphragms reach an end-of stroke position as the gas expands in the one chamber, thereby moving the diaphragms from a first position to a second position.

11. A system for controlling an AOD pump having a first chamber with a first diaphragm and a second chamber with a second diaphragm coupled to the first diaphragm, the system including:

a valve assembly configured to provide a gas to the chambers; and a controller configured to cause the valve assembly to provide the gas to one chamber and to stop providing the gas before the diaphragms reach an end-of stroke position such that the gas expands in the one chamber, thereby moving the diaphragms from a first position to a second position.

* * * * *